US005447834A

United States Patent [19]

Fujita et al.

[11] Patent Number: 5,447,834

[45] Date of Patent: Sep. 5, 1995

[54] COLOR DIFFUSION TRANSFER PHOTOGRAPHIC MATERIAL

[75] Inventors: Munehisa Fujita; Hiroyuki Asanuma, both of Kanagawa, Japan

[73] Assignee: Fuji Photo Film Co., Ltd., Kanagawa, Japan

[21] Appl. No.: 223,822

[22] Filed: Apr. 4, 1994

Related U.S. Application Data

[63] Continuation of Ser. No. 961,388, Oct. 15, 1992, abandoned.

[30] Foreign Application Priority Data

Oct. 18, 1991 [JP] Japan ..... 3-297691

[51] Int. Cl.[6] ..... G03C 1/015; G03C 1/07; G03C 1/12; G03C 8/10

[52] U.S. Cl. ..... 430/559; 430/217; 430/223; 430/569; 430/572; 430/574; 430/599; 430/606

[58] Field of Search ..... 430/217, 569, 223, 572, 430/574, 606, 599, 559

[56] References Cited

U.S. PATENT DOCUMENTS 4,442,201 4/1984 Takada et al. ..... 430/570
4,713,321 12/1987 Mifune et al. ..... 430/599
4,783,396 11/1988 Nakamura et al. ..... 430/606
4,845,023 7/1989 Mifune ..... 430/569
5,141,846 8/1992 Fickie et al. ..... 430/569

*Primary Examiner*—Richard L. Schilling
*Attorney, Agent, or Firm*—Sughrue, Mion, Zinn, Macpeak & Seas

[57] ABSTRACT

A color photographic material for diffusion transfer which comprises a support having thereon at least one light-sensitive silver halide emulsion layer containing a combination of a reducible dye providing compound represented by the following general formula (I) and an electron donor, said reducible dye providing compound releasing a diffusing dye when reduced, wherein at least one layer of silver halide emulsion layers contains a silver halide emulsion obtained by treating a silver halide emulsion, previously chemical sensitized in the presence of a sensitizing dye, with a solid adsorbent to desorb a part or the whole of the adsorbed dye.

$$PWR\text{-}(Time)_t\text{-}Dye \quad (I)$$

wherein PWR represents a group which releases -(Time)$_t$-Dye when reduced; Time represents a group which releases Dye through subsequent reactions after -(Time)$_t$-Dye is released from PWR; t represents an integer of 0 or 1; and Dye represents a dye or a precursor thereof.

5 Claims, No Drawings

COLOR DIFFUSION TRANSFER PHOTOGRAPHIC MATERIAL

This is a continuation of application Ser. No. 07/961,388 filed Oct. 15, 1992, now abandoned.

FIELD OF THE INVENTION

This invention relates to a color diffusion transfer photographic material, and more particularly to a color diffusion transfer photographic material having improved chemical sensitization performance, dye adsorption performance and color sensitization performance achieved by carrying out chemical sensitization with sensitizing dyes, then desorbing a part or all of the materials which become useless and optionally re-adsorbing sensitizing dyes requisite for spectral sensitization in the preparation of silver halide emulsions.

BACKGROUND OF THE INVENTION

Generally, silver halide emulsions are prepared through such stages that a soluble silver salt is mixed with a soluble halide in an aqueous gelatin solution to form silver halide grains and the resulting emulsions are desalted and then chemically sensitized.

It is known that sensitizing dyes may be used as chemical sensitization aids by adding them in the chemical sensitization stage to control chemical sensitization nuclei, improve high illumination non-linearity and inhibit inherent desensitization. These methods are described in, for example, JP-A-58-113926 (the term "JP-A" as used herein means an "unexamined published Japanese patent application"), JP-A-58-113927, JP-A-58-113928, U.S. Pat. Nos. 4,439,520 and 4,435,501, Research Disclosure, Item 17643, section III, JP-A-62-6251, JP-A-58-126526, JP-A-62-56949, JP-A-62-43644, JP-A-58-113928, Japanese Patent Application No. 62-203635, JP-A-1-40938, JP-A-1-62631, JP-A-1-62632, JP-A-1-74540, JP-A-1-158425 and JP-A-2-34.

Examples of the sensitizing dyes which can be added include cyanine dyes, merocyanine dyes, complex cyanine dyes, holopolar cyanine dyes, hemicyanine dyes, styryl dyes and hemioxanol dyes. For example, reference can be made to JP-A-61-160739.

When the sensitizing dyes are conventionally used as chemical sensitizing aids, sensitizing dyes having absorptions according to the purpose of spectral sensitization are always allowed to be previously adsorbed by the silver halide emulsion grains to control the formation of chemical sensitization nuclei before chemical sensitization is carried out.

In this case, a problem is often caused in that photographic performance is deteriorated by development restraint, residual color, inherent desensitization, fog, etc. due to adsorbed dyes. In addition, when the sensitizing dyes are adsorbed and spectral sensitization is then carried out, the sensitizing dyes used as the chemical sensitization aids often exhibit unfavorable spectral characteristics. Even when sensitizing dyes favorable to spectral sensitization are used as chemical sensitization aids, unfavorable chemical sensitization characteristics sometimes occur.

Accordingly, there are cases in which sensitizing dyes favorable to spectral sensitization are often not preferred as the chemical sensitizing aids, while sensitizing dyes preferred as the chemical sensitizing aids are often unfavorable for spectral sensitization.

Under such circumstances, attempts have been made to develop sensitizing dyes serving as excellent chemical sensitization aids as well as excellent spectral sensitizing agents. However, sensitizing dyes having both functions are rare.

Accordingly, it has been demanded to develop a method wherein the function of controlling chemical sensitization nuclei and the function of carrying out spectral sensitization are separately carried out in the technical field in which sensitizing dyes are used as chemical sensitization aids.

When sensitizing dyes represented by general formula (D-2) described hereinafter are used as the chemical sensitization aids, there is a side effect of increasing fog. Hence, it is demanded to decrease this undesirable side effect. As a method for solving this problem, a method has been proposed wherein nitrogen-containing heterocyclic compounds are used together with the above sensitizing dyes as described in JP-A-62-89952. However, the improvement is still insufficient.

Under such circumstances, it has been demanded to develop a method wherein the sensitivity of silver halide emulsions which are spectrally sensitized by sensitizing dyes represented by general formula (D-2) described hereinafter can be increased and fogging can be reduced.

Further, an increase in the fogging of the silver halide emulsions spectrally sensitized by general formula (D-2) has become a serious problem in the field of color diffusion transfer photographic materials because rapid processing has been demanded.

SUMMARY OF THE INVENTION

An object of the present invention is to provide a method wherein the function of controlling chemical sensitization nuclei and the function of carrying out spectral sensitization are separately carried out in the technical field in which sensitizing dyes are used as chemical sensitization aids.

Another object of the present invention is to provide a method wherein the sensitivity of silver halide emulsions spectrally sensitized by sensitizing dyes represented by general formula (D-2) described hereinafter can be increased and the fogging thereof can be reduced.

Still another objected of the present invention is to provide a method wherein the sensitivity of silver halide emulsions spectrally sensitized by sensitizing dyes represented by general formula (D-2) described hereinafter can be increased and the fogging thereof can be reduced by removing a part or all of the sensitizing dyes added as chemical sensitization aids after the completion of chemical sensitization and then allowing sensitizing dyes most suitable for spectral sensitization to be adsorbed by the silver halide emulsions.

A further object of the present invention is to provide a color diffusion transfer photographic material which is improved in chemical sensitization performance, dye adsorption performance and color sensitization performance.

A still further object of the present invention is to increase the sensitivity and maximum density area (corresponding to the unexposed area) of a color light-sensitive material for diffusion transfer which forms a positive image by using a negative type silver halide emulsion in combination with a nondiffusing compound (positive dye providing compound) which releases a diffusing dye in counter-correspondence to a reaction wherein silver halide is reduced to silver.

The above-described objects of the present invention have been achieved by providing the following color diffusion transfer photographic material:

(1) A color diffusion transfer photographic material which comprises a support having thereon one or more light-sensitive silver halide emulsion layers combined with a reducible dye providing compound represented by the following general formula (I) and an electron donor, said reducible dye providing compound releasing a diffusing dye when reduced, wherein at least one of the silver halide emulsion layers contains a silver halide emulsion obtained by:

chemically sensitizing the silver halide emulsion in the presence of a first sensitizing dye which is adsorbed into the silver halide emulsion, and treating the silver halide emulsion with a solid adsorbent to desorb a part or all of the first sensitizing dye:

$$PWR\text{-}(Time)_t\text{-}Dye \qquad (I)$$

wherein PWR represents a group which releases -(Time)$_t$-Dye when reduced; Time is a group which releases Dye through subsequent reactions after -(Time)$_t$-Dye is released from PWR; t represents an integer of 0 or 1; and Dye represents a dye or a precursor thereof.

(2) A second embodiment of the invention comprises a color diffusion transfer photographic material as described in paragraph (1) above, wherein the color photographic material contains a silver halide emulsion obtained by treating a silver halide emulsion with a solid adsorbent to desorb a part or all of the first sensitizing dye and allowing a second sensitizing dye to be again adsorbed by the silver halide emulsion.

(3) A third embodiment of the invention comprises a color diffusion transfer photographic material as described in paragraph (2) above, wherein the first sensitizing dye is different from the second sensitizing dye.

(4) A fourth embodiment of the invention comprises a color diffusion transfer photographic material as described in paragraph (3) above, wherein the first sensitizing dye is a compound represented by the following general formula (D-1), and the second sensitizing dye is a compound represented by the following general formula (D-2):

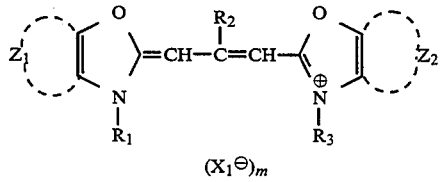

(D-1)

In general formula (D-1), $Z_1$ and $Z_2$ may be the same or different and each represents a non-metallic atomic group required for forming a benzene ring or a naphthalene ring; $R_1$ and $R_3$ may be the same or different and each represents a substituted or unsubstituted alkyl group; $R_2$ represents a hydrogen atom, a substituted or unsubstituted alkyl group or a substituted or unsubstituted aryl group; $X_1$ represents a counter ion; and m represents 0 or 1 and when m is 0, the compound forms an inner salt.

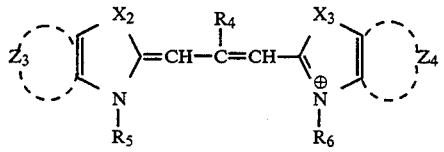

(D-2)

In general formula (D-2), $X_2$ and $X_3$ each independently represents a sulfur atom or a selenium atom; $Z_3$ and $Z_4$ each represents a non-metallic atomic group required for forming a benzene ring or a naphthalene ring; $R_4$ represents a hydrogen atom, an alkyl group having not more than 6 carbon atoms, an aralkyl group having not more than 12 carbon atoms or a phenyl group; $R_5$ and $R_6$ each represents an alkyl group having not more than 10 carbon atoms or an alkyl group having not more than 10 carbon atoms substituted by a sulfo group, a hydroxyl group, a carboxyl group, a carbamoyl group, a sulfophenyl group, a carboxylphenyl group, an alkoxy group, a phenyl group or a halogen atom; and at least one of $R_5$ and $R_6$ is a group having a sulfo group or a carboxyl group.

DETAILED DESCRIPTION OF THE INVENTION

Now, the present invention will be described in more detail below.

In preparing the silver halide emulsion of the present invention, a sensitizing dye is adsorbed by the surfaces of the silver halide grains either before the silver halide emulsion is chemically sensitized or simultaneously with the chemical sensitization of the silver halide emulsion, and a part or all of the sensitizing dye is desorbed with an adsorbent after chemical sensitization. If desired, a sensitizing dye is again adsorbed by the silver halide grains. It is desirable that a solid adsorption carrier is mainly used as the adsorbent.

It is known from the disclosures of JP-A-61-219948, JP-A-61-219949, JP-A-62-23035 and JP-A-62-240951 that chemical sensitizing agents such as gold compounds which become useless after chemical sensitization or chemical sensitization aids such as azaindenes may be removed with an adsorption carrier such as an ion exchange resin or an inorganic ion exchanger. However, these patent specifications do not disclose that sensitizing dyes used as chemical sensitizing agents are in fact removed, nor do they disclose that after sensitizing dyes used as chemical sensitizing agents are removed, sensitizing dyes of different types may be adsorbed.

It is known from the disclosure of JP-A-1-201651 that sensitizing dyes which become useless after chemical sensitization may be removed, or chemical sensitizing agents other than sensitizing dyes or chemical sensitization aids may be removed. However, this removal method involves a combination of pH control or pAg control and a rinsing stage, and the degree of desorption is very insufficient. Further, a removal method using a solid adsorbent for dyes according to the present invention is not described at all.

The adsorbed amount of the first sensitizing dye is generally from 20 to 100% and preferably from 50 to 90%, based on the saturated adsorption amount. The adsorbed amount can be evaluated using the absorption spectrum.

The desorption ratio (desorbed amount/adsorbed amount×100) of the first sensitizing dye in the present invention is preferably not lower than 50%, more preferably 80 to 100%.

Examples of sensitizing dyes which can be used in the present invention include cyanine dyes, merocyanine dyes, complex cyanine dyes, holopolar cyanine dyes, hemicyanine dyes, styryl dyes and hemioxonol dyes. Particularly useful sensitizing dyes are sensitizing dyes belonging to the group consisting of cyanine dyes, merocyanine dyes and complex merocyanine dyes.

Any of the nuclei, as basic heterocyclic nuclei, conventionally used in cyanine dyes can be used in these dyes. Examples of suitable nuclei which can be used in such dyes include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; nuclei formed by fusing an alicyclic hydrocarbon ring with the above nuclei and nuclei formed by fusing an aromatic hydrocarbon ring with the above nuclei such as an indolenine nucleus, a benzindolenine nucleus, an indole nucleus, a benzoxazole nucleus, a naphthoxazole nucleus, a benzthiazole nucleus, a naphthothiazole nucleus, a benzosetenazole nucleus, a benzimidazole nucleus and a quinoline nucleus. These nuclei may be substituted on carbon atoms.

Five-membered or six-membered heterocyclic nuclei such as a pyrazoline-5-one nucleus, a thiohydantoin nucleus, a 2-thiooxazolidine-2,4-dione nucleus, a thiazolidine-2,4-dione nucleus, a rhodanine nucleus and a thiobarbituric acid nucleus as nuclei having a ketomethylene structure can be used in merocyanine dyes or complex merocyanine dyes.

For example, the compounds described in *Research Disclosure* No. 17643, page 23, item IV (December 1978) or the compounds described in the literature cited therein can be used.

The effect of the present invention is more remarkable when a silver halide emulsion previously chemically sensitized in the presence of a sensitizing dye of general formula (D-1) is treated with a solid adsorbent to desorb a part or all of the adsorbed dye and a sensitizing dye of general formula (D-2) is then adsorbed by the silver halide emulsion.

The sensitizing dyes represented by general formula (D-1) will be illustrated in more detail below.

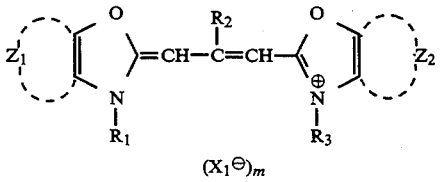

(D-1)

In general formula (D-1), $Z_1$ and $Z_2$ may be the same or different and each represents a non-metallic atomic group of atoms for forming a benzene ring or a naphthalene ring; $R_1$ and $R_3$ may be the same or different and each represents a substituted or unsubstituted alkyl group; $R_2$ represents a hydrogen atom, an alkyl group or an aryl group, which may be substituted or unsubstituted; $X_1^-$ represents a counter anion; and m represents 0 or 1 and when the compound forms an inner salt, m is 0.

The benzene ring or the naphthalene ring formed by $Z_1$ and $Z_2$ may be substituted. For example, when the heterocyclic moiety formed by $Z_1$ and $Z_2$ is represented by benzoxazole, examples thereof include benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-butoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-amyloxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho[1,2-d]oxazole, naphtho[2,3-d]oxazole and 5-nitronaphtho[2,1-d]oxazole.

When the heterocyclic moiety is represented by benzoxazole, the most preferred examples of the heterocyclic moiety formed by $Z_1$ and $Z_2$ include 5-chlorobenzoxazole, 5-bromobenzoxazole, 5-fluorobenzoxazole, 5-phenylbenzoxazole, 5-methoxybenzoxazole, 5,6-dimethylbenzoxazole, naphtho[2,1-d]oxazole, naphtho[1,2-d]oxazole, and naphtho[2,3-d]oxazole.

The alkyl group represented by $R_1$ and $R_3$ includes an unsubstituted alkyl group and a substituted alkyl group. Preferably, $R_1$ and $R_3$ are each an alkyl group having not more than 8 carbon atoms (e.g., methyl, ethyl, propyl, vinylmethyl, butyl, pentyl, hexyl, heptyl, octyl), an aralkyl group having not more than 10 carbon atoms (e.g., benzyl, phenethyl, 3 -phenylpropyl) or an alkyl group having not more than 6 carbon atoms substituted by one or more of a hydroxyl group, a carboxyl group, a sulfo group, a cyano group, a halogen atom (e.g., fluorine, chlorine, bromine), an alkoxycarbonyl group having not more than 8 carbon atoms (e.g., methoxycarbonyl, ethoxycarbonyl, benzyloxycarbonyl), an alkoxy group having not more than 8 carbon atoms (e.g., methoxy, ethoxy, butyloxy, benzyloxy, phenethyloxy), an aryloxy group having not more than 8 carbon atoms (e.g., phenoxy, p-tolyloxy), an acyloxy group having not more than 8 carbon atoms (e.g., acetyloxy, propionyloxy, benzoyloxy), an acyl group having not more than 8 carbon atoms (e.g., acetyl, propionyl, benzoyl, 4 -fluorobenzoyl), a carbamoyl group having not more than 6 carbon atoms (e.g., carbamoyl, N,N-dimethylcarbamoyl, morpholinocarbonyl, piperidinocarbonyl), a sulfamoyl group having not more than 6 carbon atoms (e.g., sulfamoyl, N,N-dimethylsulfamoyl, morpholinosulfonyl, piperidinosulfonyl) and an aryl group having not more than 10 carbon atoms (e.g., phenyl, p-fluorophenyl, p-hydroxyphenyl, p-carboxyphenyl, p-sulfophenyl).

Further, it is preferred that at least one of $R_1$ and $R_3$ be a sulfoalkyl group or a carboxyalkyl group.

The alkyl group and the aryl group represented by $R_2$ may be substituted or unsubstituted. Preferably, $R_2$ is an alkyl group having not more than 4 carbon atoms (e.g., methyl, ethyl, propyl, butyl, benzyl, phenethyl, 3 -phenylpropyl) or an aryl group having not more than 10 carbon atoms (e.g., phenyl, p-tolyl).

$X_1^-$ represents an inorganic or organic acid anion (e.g., chloride, bromide, iodide, p-toluenesulfonate, p-nitrobenzenesulfonate, methanesulfonate, methylsulfonate, ethylsulfonate, perchlorate).

Specific examples of the sensitizing dyes of general formula (D-1) include, but are not limited to, the following compounds.

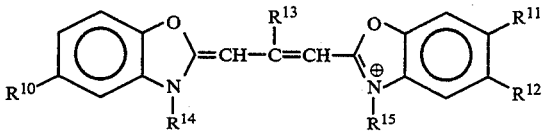

| | $R^{10}$ | $R^{11}$ | $R^{12}$ | $R^{13}$ | $R^{14}$ | $R^{15}$ |
|---|---|---|---|---|---|---|
| D-I-1 | 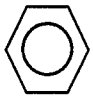 | H | 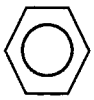 | $C_2H_5$ | $(CH_2)_2SO_3^{\ominus}$ | 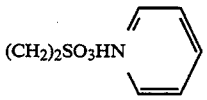 |
| D-I-2 | 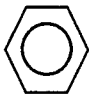 | H | Cl | $C_2H_5$ | $(CH_2)_2SO_3^{\ominus}$ | $(CH_2)_3SO_3H.N(C_2H_5)_3$ |
| D-I-3 | Cl | H | Cl | $C_2H_5$ | $(CH_2)_3SO_3^{\ominus}$ | $(CH_2)_3SO_3Na$ |
| D-I-4 | $OCH_3$ | H | $OCH_3$ | $C_2H_5$ | $(CH_2)_3SO_3^{\ominus}$ | $(CH_2)_3SO_3K$ |
| D-I-5 | 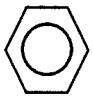 | H | $O(CH_2)_3CH_3$ | $C_2H_5$ | $(CH_2)_3SO_3^{\ominus}$ | $(CH_2)_3SO_3K$ |
| D-I-6 | $OCH_3$ | H | $OCH_3$ | $CH_3$ | $(CH_2)_3SO_3^{\ominus}$ | $(CH_2)_3SO_3Na$ |
| D-I-7 | Cl | H | Cl | H | $(CH_2)_4SO_3^{\ominus}$ | $(CH_2)_4SO_3Na$ |
| D-I-8 | 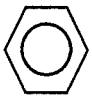 | H | 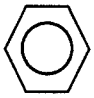 | 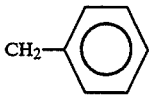 | $(CH_2)_3SO_3^{\ominus}$ | $(CH_2)_3SO_3H$ |
| D-I-9 | 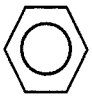 | H | 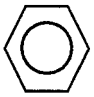 | $C_2H_5$ | $(CH_2)_2SO_3^{\ominus}$ | $CH_3$ |
| D-I-10 | 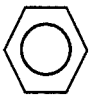 | H | $(n)C_4H_9$ | $C_2H_5$ | $(CH_2)_2SO_3^{\ominus}$ | $(CH_2)_2SO_3Na$ |
| D-I-11 | $(n)C_4H_9$ | H | $OC_4H_9(n)$ | $C_2H_5$ | $(CH_2)_3SO_3^{\ominus}$ | $(CH_2)_3SO_3K$ |
| D-I-12 | $CH_3$ | H | $CH_3$ | H | $(CH_2)_3SO_3^{\ominus}$ | $(CH_2)_3SO_3K$ |
| D-I-13 | 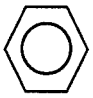 | $OC_5H_{11}(n)$ | H | $C_2H_5$ | $(CH_2)_3SO_3^{\ominus}$ | $(CH_2)_4SO_3H$ |
| D-I-14 | $OC_4H_9(n)$ | H | $OC_4H_9(n)$ | H | $(CH_2)_4SO_3^{\ominus}$ | $(CH_2)_4SO_3H$ |
| D-I-15 | $OC_7H_{15}(n)$ | H | $OC_7H_{15}(n)$ | $CH_3$ | $(CH_2)_3SO_3^{\ominus}$ | $(CH_2)_3SO_3H.N(C_2H_5)_3$ |
| D-I-16 | 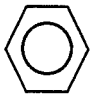 | H | 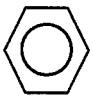 | $C_2H_5$ | $(CH_2)_4SO_3^{\ominus}$ | $(CH_2)_4SO_3Na$ |

D-I-17

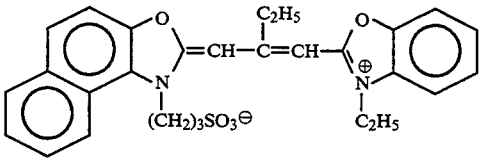

The sensitizing dyes of general formula (D-2) will be described below.

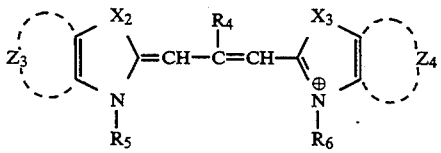

(D-2)

In general formula (D-2), $X_2$ and $X_3$ independently represent a sulfur atom or a selenium atom; $Z_3$ and $Z_4$ each represents a non-metallic atomic group for forming a benzene ring or a naphthalene ring; $R_4$ represents a hydrogen atom, an alkyl group having not more than 6 carbon atoms, an aralkyl group having not more than 12 carbon atoms or a phenyl group; and $R_5$ and $R_6$ each represents an alkyl group having not more than 10 carbon atoms or an alkyl group having not more than 10 carbon atoms substituted by a sulfo group, a hydroxyl group, a carboxyl group, a carbamoyl group, a sulfophenyl group, a carboxyphenyl group, an alkoxy group, a phenyl group or a halogen atom, and at least one of $R_5$ and $R_6$ is a group having a sulfo group or a carboxyl group.

Among the compounds of general formula (D-2), compounds represented by the following general formula (D-3) are preferable.

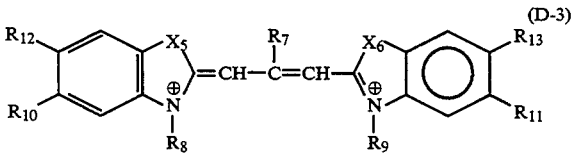

(D-3)

In general formula (D-3), $X_5$ and $X_6$ may be the same or different and each represents a sulfur atom or a selenium atom; $R_7$ represents an ethyl group, a propyl group, a butyl group or a phenethyl group; $R_8$ and $R_9$ each represents a sulfoalkyl group having 2 to 4 carbon atoms, a carboxyalkyl group having 2 to 5 carbon atoms, a hydroxyalkyl group having 2 to 6 carbon atoms, an unsubstituted carbamoyl group-substituted alkyl group having 2 to 5 carbon atoms or a lower alkyl group having not more than 6 carbon atoms. The lower alkyl group may be substituted by one or more of a fluorine atom, a chlorine atom, an alkoxy group having 1 to 4 carbon atoms, a phenyl group, a sulfophenyl group and a carbophenyl group. At least one of $R_8$ and $R_9$ is a group having a sulfo group or a carboxyl group.

R10 and $R_{11}$ independently represent a hydrogen atom, a chlorine atom, a bromine atom, a lower alkyl group having 1 to 7 carbon atoms, a lower alkoxy group having 1 to 6 carbon atoms, a carboxyl group, a hydroxyl group, an alkoxycarbonyl group having 2 to 5 carbon atoms, an acylamino group (acyl portion having 2 to 5 carbon atoms) or a phenyl group. The phenyl group may be substituted by one or more of a chlorine atom, a bromine atom, an alkyl group having not more than 4 carbon atoms and an alkoxy group having not more than 4 carbon atoms.

R12 and R13 independently represent a hydrogen atom, a chlorine atom, a bromine atom, a lower alkyl group having 1 to 7 carbon atoms, an alkoxy group having 1 to 6 carbon atoms, a hydroxyl group or an acylamino group (acyl portion having 2 to 5 carbon atoms).

Specific examples of the sensitizing dyes of general formula (D-2) include, but are not limited to, the following compounds.

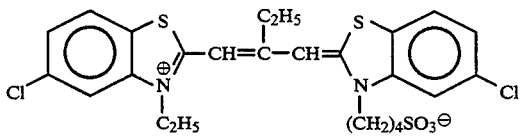

D-II-1

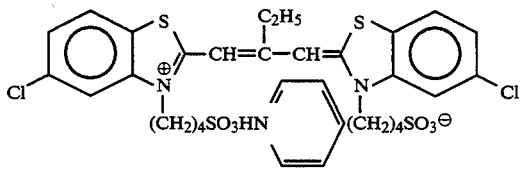

D-II-2

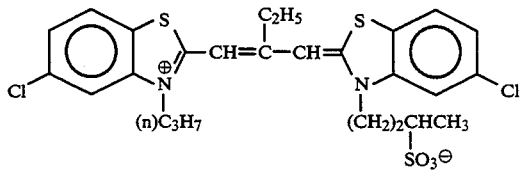

D-II-3

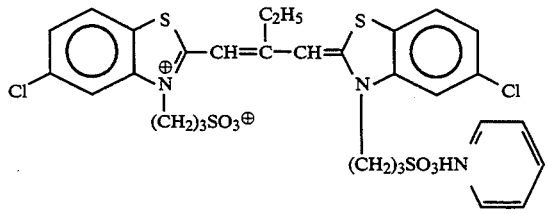

D-II-4

-continued
D-II-5
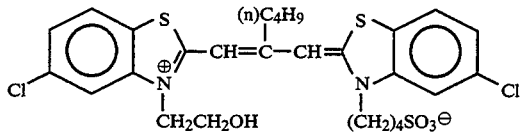
D-II-6
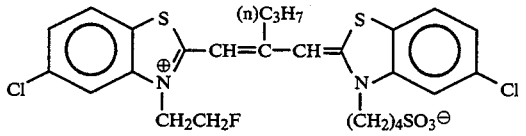
D-II-7
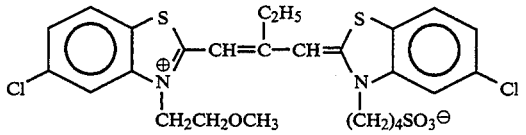
D-II-8
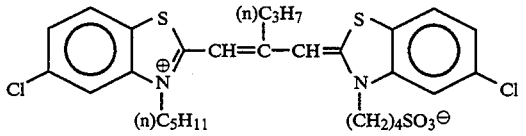
D-II-9
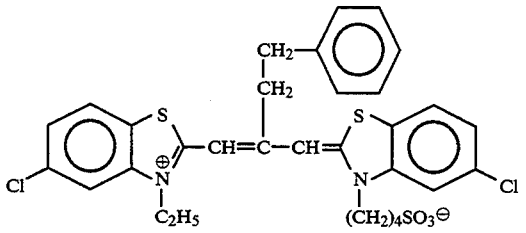
D-II-10
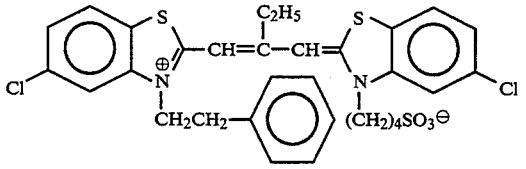
D-II-11
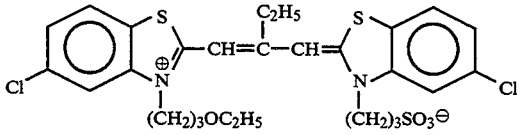
D-II-12
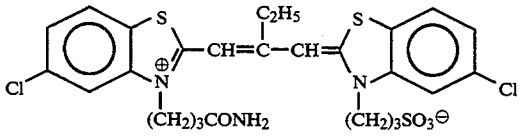
D-II-13
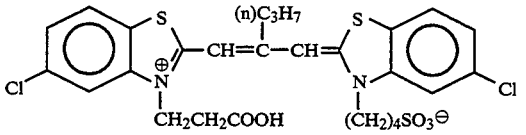
D-II-14
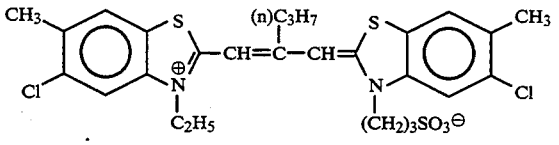

-continued
D-II-15
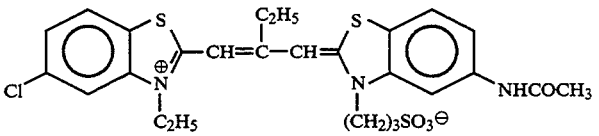
D-II-16
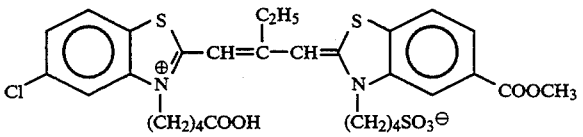
D-II-17
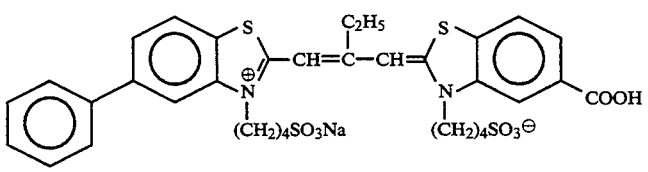
D-II-18
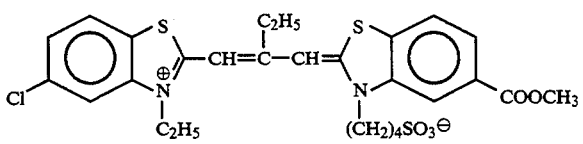
D-II-19
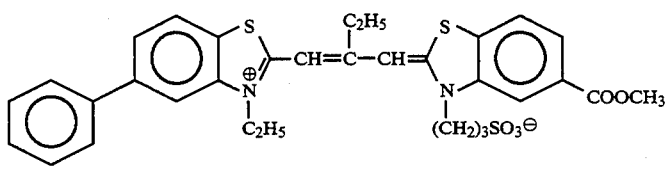
D-II-20
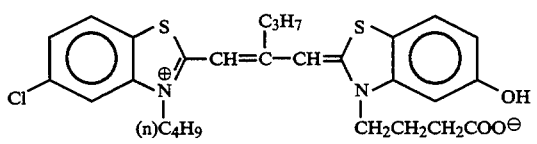
D-II-21
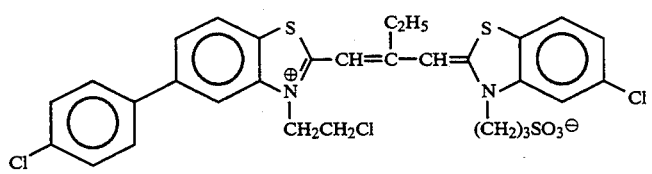
D-II-22
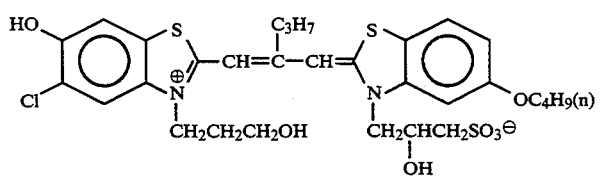
D-II-23
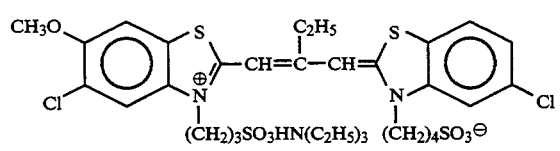

-continued
D-II-24
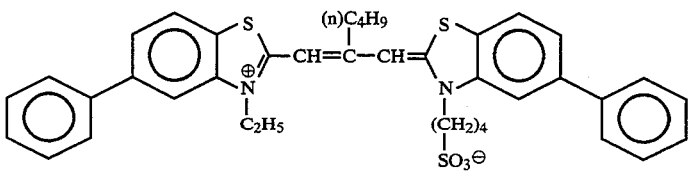
D-II-25
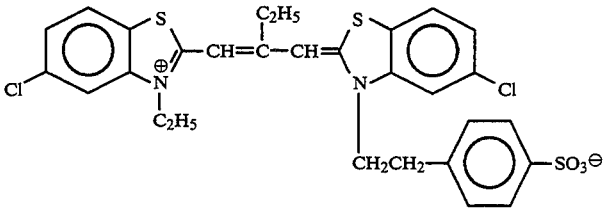
D-II-26
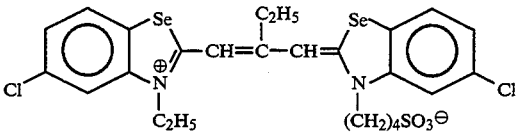
D-II-27
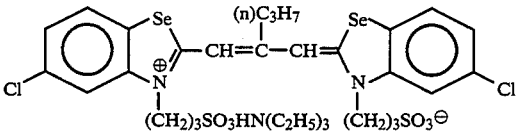
D-II-28
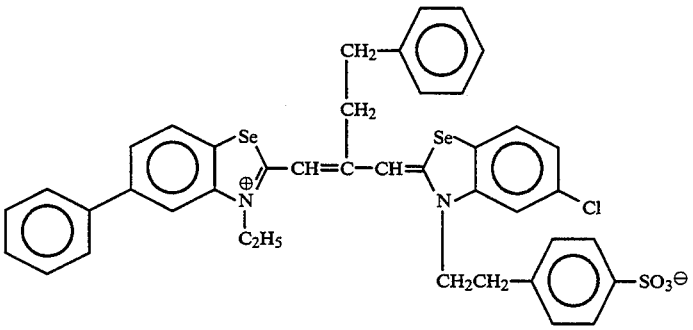
D-II-29
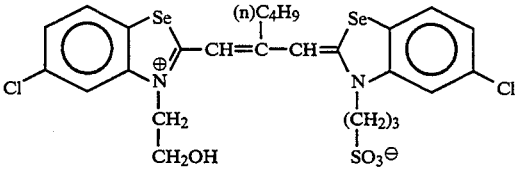
D-II-30
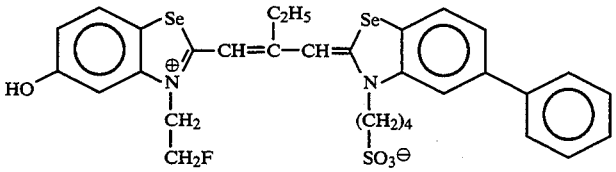
D-II-31
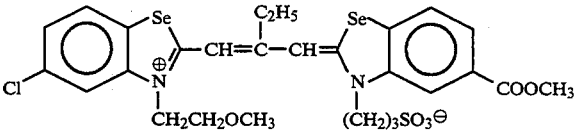

-continued

D-II-32

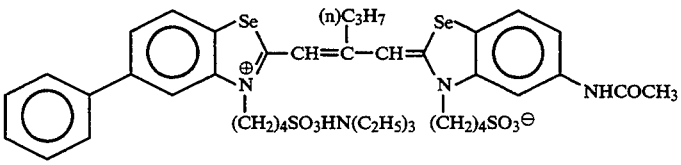

D-II-33

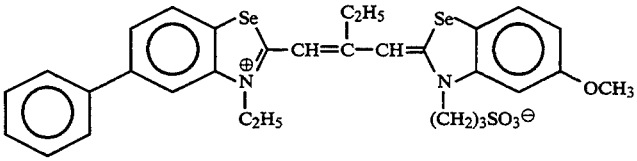

D-II-34

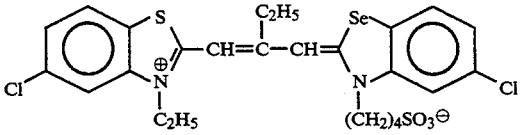

D-II-35

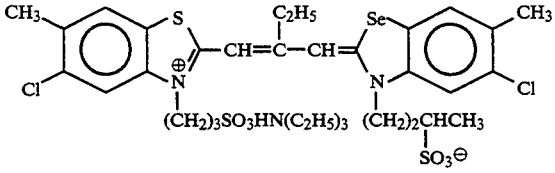

The sensitizing dyes of general formulas (D-1), (D-2) and (D-3) which can be used in the present invention can be easily synthesized according to the methods described in Heterocyclic Compounds-Cyanine Dyes and Related Compounds, Chapters IV, V, VI, pages 86 to 199, written by F. M. Hamer (John Wiley & Sons, New York, London, 1964 ) and Heterocyclic Compounds—Special Topics in Heterocyclic Chemistry, Chapter VIII, Sec. IV, pages 482 to 515, written by D. M. Sturmer (John Wiley & Sons, New York, London, 1977).

The sensitizing dyes of the present invention can be directly dispersed in emulsions. Alternatively, the sensitizing dyes may be dissolved in an appropriate solvent such as methyl alcohol, ethyl alcohol, methyl cellosolve, acetone, water, pyridine or a mixed solvent thereof, and the resulting solution can be added to the emulsions. Further, the sensitizing dyes can be dissolved by using ultrasonic waves. Examples of methods for adding the sensitizing dyes include a method wherein a dye is dissolved in a volatile organic solvent, the resulting solution is dispersed in a hydrophilic colloid, and the resulting dispersion is added to an emulsion as described in U.S. Pat. No. 3,469,987; a method wherein a water-insoluble dye is not dissolved, but is dispersed in an aqueous solution of a solvent, and the resulting dispersion is added to an emulsion as described in JP-B-46 -24185 (the term "JP-B" as used herein means an "examined Japanese patent publication"); a method wherein a dye is dissolved in a surfactant, and the resulting solution is added to an emulsion as described in U.S. Pat. No. 3,822,135; a method wherein a dye is dissolved by using a compound which causes red shift, and the resulting solution is added to an emulsion as described in JP-A-51 -74624; and a method wherein a dye is dissolved in an acid which is substantially free from water, and the resulting solution is added to an emulsion as described in JP-A-50 -80826. Further, the methods described in U.S. Pat. Nos. 2,912,343, 3,342,605, 2,996,287 and 3,429,835 can be used.

The sensitizing dyes of general formulas (D-1) and (D-2) according to the present invention may be used in an amount sufficient to effectively increase the sensitivity of the emulsions. The amount of the sensitizing dyes to be added will vary widely depending on the conditions of the emulsions, but is preferably $10^{-8}$ to $10^{-2}$ mol per mol of silver halide.

The adsorbed amount of the sensitizing dyes of formula (D-1) or (D-2) is generally from 20 to 100% and preferably from 50 to 90%, based on the saturated adsorption amount.

The term "solid adsorbent" as used herein refers to an inorganic or organic solid which is insoluble in water. Examples of a solid adsorbent include (1) activated carbon, (2) an ion exchange resin, (3) a porous resin, (4) a porous organic synthetic resin having no ion exchange group, and (5) an inorganic adsorption carrier.

Specifically, the activated carbon which can be used in the present invention includes activated carbon made from coconut shells. Any of the activated carbons described in *Activated Carbon,* edited by The Carbon Society of Japan (published by Kodan Sha 1978) can also be used.

Examples of a suitable ion exchange resin which can be used in the present invention include cation exchange resins such as Amberlite IR-120 (manufactured by Rohm & Haas Co.), Diaion SK-1B, SK-102, SK-104, SK-106, SK-110, SK-112, SK-116, PK-206, PK-212, PK-216, PK-220, PK-228, WK-10, WK-11, WK-20 (manufactured by Mitsubishi Kasei Corp.) and Powdex (powder resin) PCH; anion exchange resins such as Dowex 1×8 (manufactured by Dow Chemical Co.), Diaion SA-10 A, SA-11 A, SA-12 A, SA-20A, SA-21A, PA-306, PA-308, PA-312, PA-316, PA-318, PA-416, PA-408, PA-412, PA-416, PA-418, WA-10, WA-11, WA-20, WA-21, WA-30 (manufactured by Mitsubishi Kasei Corp.), Powdex (powder resin) PAO; and chelate resins such as Diaion CR-10 and CR-20 (Mitsubishi Kasei Corp.).

Many ion exchange resins are on the market and are easily available according to purpose. Ion exchange resins which are not commercially available can be synthesized according to the methods described in Hojo, *Chelate Resin Ion Exchange Resin,* published by Kodansha, (1976). These resins can be used as solid adsorbents.

The term "porous resin" as used herein refers to an organic synthetic resin having macropores having an average pore size of not larger than 500 nm.

The term "porous organic synthetic resin having no ion exchange group" as used herein refers to an organic synthetic resin (1) which has macropores having an average pore size of not larger than 500 nm, and (2) which does not itself have a functional group which is dissociated into positive and negative ions, such as a quaternary amine group, a carboxyl group or a sulfo group.

Examples of a suitable porous organic synthetic resin include a styrene-divinylbenzene copolymer, a chloromethylstyrene-divinylbenzene copolymer, a methoxymethylol-divinylbenzene copolymer, an ethylene-divinyl-benzene copolymer, a methyl methacrylate-divinylbenzene copolymer and a methyl acrylate-divinylbenzene copolymer.

Specifically, these resins can be represented by the following structures.

1.

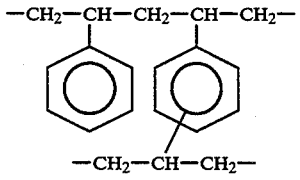

2.

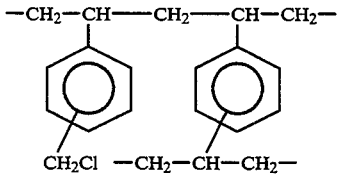

3.

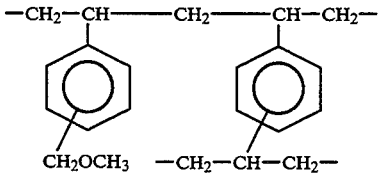

4.

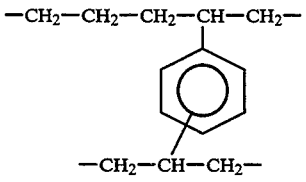

-continued

5.

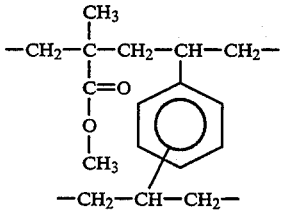

6.

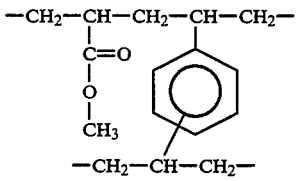

The synthesis methods of the porous resins include known methods such as a linear polymer addition method and a precipitant addition method as described in *Chelate Resin Ion Exchange Resin,* Chapter 2, (page 127 -) written by Josei Hojo. However, the porous resins may be synthesized by any method. Many porous resins are on the market and are easily commercially available according to purpose and use. Examples of commercially available resins include those given in the following Tables.

| Trade name (products of Mitsubishi Kasei Corp.) | Base resin | Specific surface area ($m^2$/g-HP) | Pore capacity (ml/g-HP) | Radius of maximum frequency (Å) |
|---|---|---|---|---|
| HP10 | styrene | 500 | 0.9 | 100–700 |
| HP20 | styrene | 720 | 1.1 | 100–1300 |
| HP30 | styrene | 570 | 1.0 | 100–900 |
| HP40 | styrene | 700 | 0.7 | 100–600 |
| HP50 | styrene | 600 | 0.9 | 900 |

| Trade Name (products of Mitsubishi Kasei Corp.) | Particle size (μm) | Specific surface area ($m^2$g) | Pore capacity (ml/g) |
|---|---|---|---|
| MCI GEL CHP20P | 37–75 | 500–700 | >1 |
| " | 75–150 | 500–700 | >1 |
| " | 150–300 | 500–700 | >1 |

| Trade name (products of Rohm & Haas Co.) | Base resin | Specific surface area ($m^2$/g-HP) | Pore capacity (ml/g-HP) | Radius of maximum frequency (Å) |
|---|---|---|---|---|
| XAD 1 | styrene | 100 | — | 205 |
| XAD 2 | styrene | 300 | 0.6 | 90 |
| XAD 4 | styrene | 784 | 1.1 | 50 |
| XAD 7 | styrene | 450 | 0.8 | 90 |
| XAD 8 | styrene | 140 | 0.5 | 235 |
| XAD 9 | sulfoxide | 69 | — | 366 |
| XAD 11 | amide | 69 | — | 352 |
| XAD 12 | N—O polar group | 22 | — | 1300 |

The inorganic adsorption carrier which can be used in the present invention includes zeolites, diatomaceous earths, $MgO.nH_2O$, $MgO.xAl_2O_3.nH_2O$ (x=0 to 0.25) (inorganic adsorbent M-511 manufactured by Kunimine Kogyo KK), smectites and montmorillonites.

Examples of commercially available zeolite include synthetic zeolite A-3, synthetic zeolite A-4 and synthetic zeolite F-9 (manufactured by Wako Junyaku Kogyo KK). Any of the zeolites described in *Zeolites—Foundation and Application,* edited by Hara and Tskahashi (published by Kodansha) (1975) can be used as the solid adsorbent. Smectites and montmorillonites which can be used in the present invention include Smectone and Kunipia (manufactured by Kunimine Kogyo KK).

Among the above-described solid adsorbents, the preferred adsorbents are activated carbon, the ion exchange resins, the porous resins and the porous organic synthetic resins having no ion exchange group. More preferred are activated carbon, the porous resins and the porous organic synthetic resins having no ion exchange group. Most preferred are the porous organic synthetic resins having no ion exchange group.

The above-described solid adsorbents may be in various forms including granule, powder, membrane, etc. However, a granule form, a powder form and a membrane form are preferred.

The solid adsorbents preferably have a size which is larger than that of the silver halide grains in the silver halide emulsions. This is because after the silver halide emulsions are treated with the solid adsorbents, these solid adsorbents are often left behind in the emulsions. Some solid adsorbents do not have an adverse effect even though they are left behind in the emulsions. However, it is preferred that the solid adsorbents be removed from the emulsions, for example, by filtration.

The expression "desorption of dye with the solid adsorbent of the present invention from the silver halide emulsion" as used herein refers to a processing step where the solid adsorbent is batchwise added to the silver halide emulsion, the mixture is mixed with stirring and the solid adsorbent is then removed by filtration, or a processing step where an adsorption bed or an adsorption column is continuously packed with the solid adsorbent, and the silver halide emulsion is passed therethrough. Any of these methods can be used in the present invention.

The amounts of the solid adsorbents to be used vary depending on the performance (e.g., ion exchange capacity, the total adsorption capacity, pore capacity) and forms (e.g., particle size, effective surface area) of the adsorbents and the contents (e.g., types of chemical sensitization aids and dyes) of the silver halide emulsions to be treated. An appropriate amount thereof can be properly chosen. For example, when the process is carried out batchwise, the solid adsorbent is typically used in an amount of 0.1 to 100 g per one Kg of the silver halide emulsion. In the case of the continuous process, the solid adsorbent is used in the same range as that of the batchwise process from the viewpoint of the amount of the solid adsorbent to the total amount of the silver halide emulsion passed through the solid adsorbent bed.

The treating temperature is from a temperature at which the silver halide emulsion is liquefied (typically about 30° C.), to a temperature which the carrier can withstand. The treating time is an appropriate time, that is, at least one minute in the case of both the batchwise process and the continuous process.

Silver halide grains having various forms can be used in the present invention. For example, the silver halide grains may have a regular crystal form such as cube, octahedron, tetradecahedron or rhombic dodecahedron, an irregular crystal form such as a spherical form or a plate form, a crystal form having a face of a high order (e.g., (hkl) face), or a composite form of these crystal forms. With regard to grains having a face of a high order, reference can be made to *Journal of Imaging Science*, Vol. 30 (1986), pages 247 to 254.

The silver halide grains of the present invention may be a normal crystal having no twin plane or a crystal such as a singlet twin crystal having one twin plane, a parallel multiple twin crystal having at least two parallel twin planes or a non-parallel multiple twin crystal having at least two non-parallel twin planes as described in *Foundation of Photographic Industry, Silver Salt Photography*, page 163, edited by Photography Society of Japan (published by Corona Sha). These crystal forms can be properly chosen according to purpose.

A method for mixing grains having different forms is described in U.S. Pat. No. 4,865,964. If desired, this method can be used.

When the grains are a normal crystal, cubic grains comprising a (100) face, octahedral grains comprising a (111) face and dodecahedral grains comprising a (110) face (as described in JP-B-55 -42737 and JP-A-60 -222842) can be used. Further, grains having an (h11) face as typified by a (211) face, grains having an (hh1) face as typified by a (331) face, grains having an (kh0) face as typified by a (210) face and grains having an (hkl) face as typified by a (321) face as described in *Journal of Imaging Science*, Vol. 30, pages 247 (1986) can be used according to purpose, though the preparation thereof must be designed so as to form the desired grains.

Grains having two or more faces such as tetradecahedral grains having both a (110) face and a (111) face per grain, grains having both a (100) face and a (110) face per grain and grains having both a (111) face and a (110) face per grain can be used according to purpose.

With regard to the silver halide compositions of these grains, any of silver bromide, silver iodobromide, silver iodochlorobromide, silver chlorobromide, and silver chloroiodide and silver chloride may be used. However, silver bromide, silver chlorobromide and silver iodobromide are preferred. Further, other silver salts such as silver thiocyanate, silver cyanate, silver sulfide, silver selenide, silver carbonate, silver phosphate or a silver salt of an organic acid may be incorporated as another particle or as a part of the silver halide grains in the silver halide composition.

Silver halide grains having a high silver chloride content are desirable when development and desilverization (bleaching, fixing and bleaching-fixing) stages must be rapidly carried out. When development is properly to be retarded, it is preferred that the silver halide contains silver iodide. It is preferred from the viewpoint of relaxing lattice distortion that silver chloride be incorporated in silver iodobromide grains.

Silver halide grains may be different in phase between the interior of the grain and the surface layer thereof, or the interior of the grain and the surface layer thereof may be composed of the same phase. The silver halide composition in the grain may be uniform, the interior of the grain and the surface layer thereof may be different in silver halide composition from each other or the grain may have a laminar structure (see, JP-A-57-154232, JP-A-58-108533, JP-A-58-248469, JP-A-59 -48755, JP-A-59-52237, U.S. Pat. Nos. 3,503,068, 4,433,048 and 4,444,877, European Patent 100,984 and U.K. Patent 1,027,146). Further, grains having a dislocation line are also preferred.

Further, grains having a specific distribution or structure with regard to silver halide composition can be prepared. A typical example thereof includes core/shell type or double structure type grains wherein the interior of the grain and the surface layer thereof are different in halogen composition from each other as described in JP-B-43-13162, JP-A-61-215540, JP-A-60-222845, JP-A-60-143331 and JP-A-61-75337. Further, not only a simple double structure, but a triple structure or multi-layer structure as described in JP-A-60-222844 may be used. Furthermore, a thin layer of silver halide having a different composition can be bonded onto the surface of a core/shell type double structural grain.

Not only the enclosure type structure grains as described above but also bonded structure type grains can be prepared. Examples thereof are described in JP-A-59-133540, JP-A-58-108526, European Patent 199,290 A2, JP-B-58-24772 and JP-A-59-16254. The bonding crystal has a different composition from that of the host crystal, and may be bonded to the edges, corners or planes of the host crystal. The bonding crystal and the host crystal may be uniform in halogen composition, or may have a core/shell type structure.

A grain having a different silver halide composition may be bonded to another grain by epitaxial growth, or silver halide grains may be bonded to compounds other than silver halide, such as silver thiocyanate or an oxide. For example, silver halide crystals obtained by the epitaxial growth of a crystal of an oxide such as PbO or a silver halide crystal such as silver chloride (e.g., silver chloride, silver iodobromide or silver iodide epitaxially grown on silver bromide), hexagonal type or a crystal formed by orientating a regular hexahedral silver chloride on silver iodide may be used.

These emulsion grains are disclosed in U.S. Patents 4,094,684, 4,142,900 and 4,459,353, U.K. Patent 2,038,792, U.S. Pat. Nos. 4,349,622, 4,395,478, 4,433,501, 4,463,087, 3,656,962 and 3,852,067 and JP-A-59-162540.

When two or more silver halides are allowed to coexist as a mixed crystal or a specific structural form, it is important to control the silver halide distribution between grains. The method of measuring the silver halide composition distribution between grains is described in JP-A-60-254032. It is desirable that the halogen distribution be uniform. Particularly preferred are emulsions having such a high uniformity that the coefficient of variation is not higher than 20%. .In another embodiment, there are preferred emulsions having a correlation between grain size and halogen composition.

It is an important factor that the halogen composition in the vicinity of the surface of the grain be controlled. The adsorption of the dye or development rate is affected by the silver iodide content or the silver chloride content in the vicinity of the surface of the grains. Accordingly, the content of silver iodide or silver chloride is increased according to purpose. When the halogen composition in the vicinity of the surface of the grains is to be changed, there may be chosen any of a structure where the whole of the grain is enclosed, and a structure where another silver halide is deposited only on a part of the grain. For example, the halogen composition of only one face of a tetradecahedral grain having a (100) face and a (111) face may be changed, and only one of the principal plane and the side plane of a tabular grain may be changed.

The silver halide emulsion of the present invention may be any of a surface latent image type wherein a latent image is predominantly formed on the surface of the grains, an internal latent image type wherein a latent image is predominantly formed in the interior of the grains, and a type wherein a latent image is formed on the surface of the grains as well as in the interior thereof. However, the emulsion should be a negative type. The internal latent image type emulsion may be a core/shell type internal latent image type emulsion described in JP-A-63-264740. A method for preparing the core/shell type internal latent image type emulsion is described in JP-A-59-133542.

The grain size of the emulsion of the present invention is evaluated by the grain size corresponding to the diameter of a circle having an area equal to the projected area of the grain observed through an electron microscope, the grain size corresponding to the diameter of a sphere having a volume equal to that of the grain calculated from the projected area and the thickness of the grain, or the grain size corresponding to the diameter of a sphere having a volume equal to that of the grain determined by a coultar counter method. Grains ranging from ultrafine grains having a grain size of not larger than 0.05 m to coarse grains having a grain size of larger than 10 m in terms of the diameter of a sphere can be used. Grains having a grain size of not smaller than 0.1 m, but not larger than 3 m are preferred.

The silver halide grains may have any grain size distribution. However, a monodisperse system is preferable. The term "monodisperse" as used herein is defined as a dispersion system wherein 95% (in terms of the total weight or the number of grains) of grains is composed of grains having a grain size within the number-average grain size ±60%, preferably ±40%. The term "number-average grain size" as used herein refers to the mean grain size when the diameter of a grain is defined as the diameter of a circle having an area equal to the projected area of the grain, and the average of the diameters of the entire grains is referred to as the mean grain size.

Monodisperse emulsions-are described in U.S. Patents 3,574,628 and 3,655,394 and U.K. Patent 1,413,748. A mixture of monodisperse emulsions may be used.

Specifically, any of the silver halide emulsions described in U.S. Pat. Nos. 4,500,626 (50th column) and 4,628,021, Research Disclosure (hereinafter abbreviated to RD) 17029 (1978) and JP-A-62-253159 can be used.

Two or more silver halides having different crystal habits, halogen compositions, grain sizes and grain size distributions can be used in combination. These silver halides can be contained in different emulsion layers and/or the same emulsion layer.

.More preferred effects can be obtained in the present invention when tabular silver halide grains are used. The preparation methods and use of the tabular silver halide grains are described Cleve, *Photography Theory and Practice* (1930), page 131, Gutoff, *Photographic Science and Engineering*, Vol. 14, pp. 248 to 257 (1970), U.S. Pat. Nos. 4,434,226, 4,414,310, 4,433,048, 4,439,520, 4,414,306 and 4,459,353, U.K. Patent 2,112,157, JP-A-59-99433 and JP-A-62-209445.

Tabular grains may be in any form, for example, a triangle, a hexagon, or a circle. A regular hexagon wherein the lengths of the six sides are nearly equal as described in U.S. Pat. No. 4,797,354 is a preferred form.

In the case of the tabular grains, the dislocation line thereof can be observed by a transmission type electron microscope. Grains having no dislocation line, grains having several dislocation lines and grains having many dislocation lines can be chosen according to purpose. Grains having introduced dislocations oriented linearly in the specific direction of the crystal orientation of the grain or grains having curved dislocations can be chosen. Dislocations can be introduced into the whole of the grain or only a specific site of the grain. For example, dislocations can be introduced into only the fringe part of the grain. The dislocation lines can be introduced not only into tabular grains, but also into normal crystalline grains and indefinite type grains such as typically potato type grains. In this case, it is also preferred that the introduction of the dislocation lines into the grains be limited to a specific part such as the apex or edge of the grain.

For example, tabular silver halide grains having dislocation lines purposely introduced thereinto are disclosed in JP-A-63-220238 and JP-A-1-201649.

The preferred ratio of the mean grain diameter to the mean grain thickness (hereinafter referred to as grain diameter/thickness) of tabular grains is not lower than 2, more preferably 3 to 12, particularly preferably 5 to 8. The term "mean grain diameter" as used herein with respect to tabular silver halide grains refers to the mean value when the diameter of a grain is defined as the diameter of a circle having an area equal to one principal plane of two parallel (or nearly parallel) principal planes opposed to each other (the diameter of a particle having an area equal to the projected area of the principal plane), and the average of the diameters of the entire grains is referred to as the mean grain size. The term "mean grain thickness" as used herein with respect to tabular grains refers to the mean value when the thickness of a grain is defined as the distance between two principal planes and the average of the thicknesses of the entire grains is referred to as the mean grain thickness.

The ratio of the grain diameter to the thickness can be obtained by averaging the ratios of the grain diameters to the thicknesses of all the tabular grains, but the ratio can be simply determined as the ratio of the mean diameter of all the tabular grains to the mean thickness thereof.

The diameters (in terms of the diameter of a circle) of the tabular grains are at least 0.3 μm, preferably 0.3 to 10 μm, more preferably 0.5 to 5.0 μm, still more preferably 0.5 to 3.0 μm.

The grain thickness is less than 1.0 μm, preferably 0.05 to 0.5 μm, more preferably 0.08 to 0.3 μm.

There are preferred emulsions having such a high uniformity in thickness that the coefficient of variation in the grain thickness is not higher than 30%. Further, there are preferred grains wherein the thickness of the grains and the distance between twinning planes are prescribed as described JP-A-63-163451.

In the present invention, the tabular grains account for at least 50%, preferably at least 70%, more preferably at least 90% of the projected area of the entire grains contained in an emulsion.

The grain diameters and grain thicknesses of the tabular grains can be measured by the electron micrographs of the grains according to the method described in U.S. Pat. No. 4,434,226.

Further, it is preferred that the tabular grains be a monodisperse system in the present invention. The structures and preparation methods of the monodisperse tabular grains are described in, for example, JP-A-63-151618.

The silver halide emulsions of the present invention may be subjected to a grain rounding treatment as described in European Patents 96,727 B1 and 64,412 B1 or a surface modifying treatment as described in West German Patent 2,306,447 C2 and JP-A-60-221320.

The surface of the grain generally has a flat structure. However, it is often preferred that the surface thereof be intentionally made uneven. For example, a method may be used wherein a part of the crystal, for example, the apex or the center of the plane, has holes formed in it, as described in JP-A-58-106532 and JP-A-60-221320. Ruffle grains as described in U.S. Pat. No. 4,643,966 may also be used.

The silver halide grains of the present invention can be prepared by using the methods described in *Research Disclosure* (RD) No. 17643 (December 1978), pp. 22 to 23, "I. Emulsion Preparations and Types", ibid., No. 18716 (November 1979), page 648, ibid., No. 307105 (November 1989), pp. 863 to 865, P. Glafkides, *Chimie et Physique Photographique* (Paul Montel 1967), G. F. Duffin, *Photographic Emulsion Chemistry* (Focal Press 1966) and V. L. Zelikman et. al., *Making and Coating Photographic Emulsions* (Focal Press 1964). Namely, any of the acid process, the neutral process and the ammonia process can be used. A soluble silver salt and process, the double jet process or a combination thereof. A reverse mixing method wherein grains are formed in the presence of an excess of silver ion can be used. As a type of the double jet process, there can be used a controlled double jet process wherein the pAg in the liquid phase, in which silver halide is formed, is kept constant. According to this process, a silver halide emulsion can be obtained wherein the crystal form is regular and the grain size is nearly uniform.

The tabular grains can be simply prepared by the methods described in Gutoff, *Photographic Science and Engineering*, Vol. 14, pp. 248 to 257 (1970), U.S. Pat. Nos. 4,434,226, 4,414,310, 4,433,048 and 4,439,520 and U.K. Patent 2,112,157.

Silver halide emulsions comprising the aforementioned regular grains can be obtained by controlling the pAg and pH during the formation of the grains. The details thereof are described in, for example, *Photographic Science and Engineering*, Vol. 6, pp. 159 to 165 (1962), *Journal of Photographic Science*, Vol. 12, pp. 242 to 251 (1964), U.S. Pat. No. 3,655,394 and U.K. Patent 1,413,748.

The monodisperse emulsions are described in JP-A-48-8600, JP-A-51-39027, JP-A-51-83097, JP-A-53-137133, JP-A-54-48521, JP-A-54-99419, JP-A-58-37635, JP-A-58-49938, JP-B-47-11386, U.S. Pat. No. 3,655,394 and U.K. Patent 1,413,748.

It is sometimes preferred to use a method wherein silver halide grains previously precipitated are added to a reaction vessel for the preparation of the emulsion as described in U.S. Pat. Nos. 4,334,012, 4,301,241 and 4,150,994. In this method, the grains can be used as a seed crystal, or they can be effectively used as silver halide for growth. In the latter case, it is preferred that an emulsion comprising grains having a small grain size be added. The whole amount of the emulsion may be added at once, the emulsion may be added by dividing it into several portions, or the emulsion may be continuously added. It is also effective that grains having various halogen compositions be added to modify the surfaces of the grains.

A method wherein most or only a part of the halogen compositions of the silver halide grains is converted by a halogen conversion method, is disclosed in U.S. Pat. Nos. 3,477,852 and 4,142,900, European Patents 273,429 and 273,430 and West German Patent Laid-Open No. 3,819,241. This method is an effective grain formation method. A solution of a soluble halide or silver halide grains can be added to convert silver into a more sparingly soluble silver salt. Conversion may be made at once, or conversion may be made portionwise or continuously.

In addition to the method wherein the growth of the grains is carried out by adding a soluble silver salt and a soluble halide at a given concentration and at a given flow rate, another preferred method is a grain forming method wherein the concentration is changed or the flow rate is changed as described in U.K. Patent 1,469,480 and U.S. Pat. Nos. 3,650,757 and 4,242,455. The primary function, the secondary function or a function of higher order of the addition time of silver halide to be fed can be changed by increasing the concentration or the flow rate. It is sometimes preferred that the amount of silver halide to be fed is reduced. Further, when two or more soluble silver salts having different solution compositions or two or more soluble salts having different solution compositions are added, an addition method wherein one is increased and the other is reduced is an effective method.

Mixing vessels for reacting a soluble silver salt solution with a soluble halide solution can be chosen from among those described in U.S. Pat. Nos. 2,996,287, 3,342,605, 3,415,650 and 3,785,377, West German Patent Laid-Open Nos. 2,556,885 and 2,555,364.

Solvents for silver halide are useful to accelerate ripening. For example, it is known that an excess amount of a halogen ion may be allowed to be present in a reactor to accelerate ripening. Other ripening agents can be used. The entire amount of these ripening agents may be added to a dispersion medium in the reactor before the addition of the silver salt and the halide salt. These ripening agents may be introduced into the reactor with the addition of the silver salt, the halide salt or a deflocculating agent. In another embodiment, the ripening agents may be independently introduced into the reactor in the stage of the addition of the silver salt and the halide salt.

Examples of ripening agents which can be used in addition to the halogen ion include ammonia, amine compounds and thiocyanates such as alkali metal thiocyanates, particularly sodium or potassium thiocyanate and ammonium thiocyanate. The use of the thiocyanate ripening agents is disclosed in U.S. Pat. Nos. 2,222,264, 2,448,534 and 3,320,069. Examples of other ripening agents include organic thioether compounds (e.g., compounds described in U.S. Pat. Nos. 3,271,157, 3,574,628, 3,737,313, 3,021,215, 3,057,724, 3,038,805, 4,276,374, 4,297,439, 3,704,130 and 4,782,013 and JP-A-57-104926), thione compounds (e.g., tetra-substituted thioureas described in JP-A-53-82408, JP-A-55-77737 and U.S. Pat. No. 4,221,863 and compounds described in JP-A-53-144319), mercapto compounds Capable of accelerating the growth of silver halide grains (e.g., compounds described in JP-A-57-202531) and amine compounds (e.g., compounds described in JP-A-54-100717.)

There can be preferably used methods wherein the addition rates, amounts and concentrations of a silver salt solution (e.g., an aqueous solution of $AgNO_3$) to be added and a halide solution (e.g., an aqueous solution of KBr) to be added are increased to expedite the growth of grains during the preparation of emulsions containing tabular grains. With regard to these methods, reference can be made to U.K. Patent 1,335,925, U.S. Pat. Nos. 3,672,900, 3,650,757 and 4,242,445, JP-A-55-142329 and JP-A-55-158124. The above-described solvents for silver halide are effective in accelerating ripening.

It is preferred that a salt of a metallic ion is allowed to be present during the preparation of the emulsions of the present invention, for example, during the course of the formation of the grains, the desalting stage or chemical sensitization or before coating. When the grains are to be doped with a metal, it is preferred that the metal salt be added during the course of the formation of the grains. When the metal salt is used as a chemical sensitizing agent or to modify the surfaces of the grains, it is preferred that the metal salt be added after the formation of the grains, but before completion of chemical sensitization. The whole of the grains may be doped with a metal. Only the core or shell part of the grains or only the epitaxial grown part of the grains may be doped. Only base grains may be doped. Examples of the metals which can be used in the doping in the present invention include Mg, Ca, St, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, Bi. These metals in the form of a salt such as an ammonium salt, an acetate, a nitrate, a sulfate, a phosphate, a hydroxide, a six-coordinate complex or a four-coordinate complex can be added, so long as the salt can be dissolved during the formation of the grains. Examples of salts which can be used include $CdBr_2$, $CdCl_2$, $Cd(NO_3)_2$, $Pd(NO_3)_2$, $Pd(CH_3COO,)_2$, $K_3[Fe(CN)_6]$, $(NH_4)_4[Fe(CN)_6]$, $K_3IrCl_6$, $NH_4RhCl_6$, $K_4Ru(CN)_6$. Examples of ligands for coordination compounds include halo, aquo, cyano, cyanate, thiocyanate, nitrosyl, thionitrosyl, oxo and carbonyl. These metal compounds may be used singly or in a combination of two, three or more of them.

It is preferred that the metal compounds be dissolved in water or an appropriate solvent such as methanol or acetone and then added. An aqueous solution of a hydrogen halide (e.g., HCl, HBr) or an alkali metal halide (e.g., KCl, NaCl, KBr, NaBr) can be added to stabilize the solution. If desired, an acid or an alkali may be added. The metal compounds may be added to the reactor before the formation of the grains or during the course of the formation of the grains. Further, the metal compounds may be continuously added during the course of the formation of the silver halide grains by adding them to an aqueous solution of a water-soluble salt (e.g., $AgNO_3$) or an aqueous solution of an alkali metal halide (e.g., NaCl KBr, KI). Furthermore, a solution of the metal compound, which is independent of the soluble silver salt solution and the alkali metal halide, may be prepared and continuously added in a timely fashion during the course of the formation of the grains. In addition thereto, a combination of two or more addition methods can be preferably used.

A method wherein a chalcogenide compound is added during the preparation of the emulsion as described in U.S. Pat. No. 3,772,031 is sometimes an effective method. A cyanate, a thiocyanate, a selenocyanate, a carbonate, a phosphate or an acetate in addition to S, Se and Te may be allowed to coexist.

These methods are described in U.S. Pat. Nos. 2,448,060, 2,628,167, 3,737,313 and 3,772,031 and *Research Disclosure,* Vol. 134 (June 1975) No. 13452.

Usually, the surfaces of the grains in the silver halide emulsions are chemically sensitized. Chemical sensitization can be carried out by using active gelatin as described in T. H. James, *The Theory of the Photographic Process,* 4th ed. (Macmillan 1977) pp. 67 to 76. Further, chemical sensitization can be carried out at a pAg of 5 to 10, a pH of 5 to 8 and a temperature of 30° to 80° C. by using a sulfur, selenium, tellurium, gold, platinum, palladium, iridium or rhodium sensitizing agent or a combination of two or more of them. Most suitably, chemical sensitization is carried out in the presence of a gold compound and a thiocyanate compound, in the presence of a sulfur-containing compound described in U.S. Pat. Nos. 3,857,711, 4,266,018 and 4,054,457, or in the presence of a sulfur-containing compound such as hypo, a thiourea compound or a rhodanine compound.

Conventional chemical sensitization aids also can be used in combination with the sensitizing dyes used as a chemical sensitizing aids in the present invention. As the chemical sensitization aid, compounds can be used which are capable of inhibiting fogging and increasing sensitivity during the course of chemical sensitization, such as azaindenes, azapyridazines and azapyrimidines. Specific examples of chemical sensitization aids are described in U.S. Pat. Nos. 2,131,038, 3,411,914 and 3,554,757, JP-A-58-126536, JP-A-62-253159 and G. F. Duffin, *Photographic Emulsion Chemistry*, pp. 138 to 143 (Focal Press 1966).

The interiors of the grains in the silver halide emulsions can be reduction-sensitized during the course of the formation of the precipitate as described in JP-B-58-1410 and Moiser et al., *Journal of Photographic Science*, Vol. 25, pp. 19 to 27 (1977).

The following reduction sensitizations can be used as chemical sensitization.

Reduction sensitization can be carried out, for example, by using hydrogen as described in U.S. Pat. No. 3,891,446 and 3,984,249; and by using a reducing agent as described in U.S. Pat. Nos. 2,518,698, 2,743,182 and 2,743,183. Further, reduction sensitization can be carried out by processing at a low pAg (e.g., lower than 5) or at a high pH (e.g., higher than 8). Typical examples of reduction sensitizing agents which are known include stannous salts, ascorbic acid and derivatives thereof, amines and polyamines, hydrazine derivatives, formamidinesulfinic acid, sitane compounds and borane compounds. These conventional reduction sensitizing agents can be used in the reduction sensitization of the present invention. These compounds may be used singly or in a combination of two or more of them. Preferred compounds as the reduction sensitizing agents are stannous chloride, thiourea dioxide, dimethylaminoborane and ascorbic acid and derivatives thereof.

The chemical sensitization methods described in U.S. Pat. Nos. 3,917,485 and 3,966,476 can be applied to the present invention.

Further, sensitizing methods using oxidizing agents as described in JP-A-61-3134 and JP-A-61-3136 can be applied to the present invention.

The oxidizing agents for silver are compounds having an effect of reacting with metallic silver to convert it into a silver ion. Compounds capable of converting very fine silver particles concomitantly formed during the course of the formation and chemical sensitization of silver halide grains into a silver ion, are particularly effective. The formed silver ion may form a silver salt which is sparingly soluble in water, such as silver halide, silver sulfide or silver selenide, or may form a silver salt which is easily soluble in water, such as silver nitrate. The oxidizing agents for silver may be inorganic materials or organic materials. Examples of inorganic oxidizing agents include ozone, hydrogen peroxide and adducts thereof (e.g., $NaBO_2.H_2O_2.3H_2$, $NaCO_3.3H_2O_2$, $Na_4P_2O_7.2H_2O_2$, $2Na_2SO_4.H_2O_2.2H_2O$), salts of peroxy acids (e.g., $K_2S_2O_8$, $K_2C_2O_6$) $K_2P_2O_8$), peroxy complex compounds (e.g., $K_2[Ti(O_2)C_2O_4].3H_2O$, $4K_2SO_4.Ti(O_2)OH.SO_4.2H_2O$), salts of oxy acids such as permanganates (e.g., $KMnO_4$) and chromates (e.g., $K_2Cr_2O_7$), halogen elements such as iodine and bromide, perhalogenates (e.g., potassium periodate, polyvalent metal salts (e.g., potassium hexacyanoferrate (III)) and thio sulfonates.

Examples of organic oxidizing agents include quinones such as p-quinone, organic peroxides such as peracetic acid and perbenzoic acid and compounds which release active halogens (e.g., N-bromosuccinimide, Chloramine T, Chloramine B).

Oxidizing agents which can be preferably used in the present invention include inorganic oxidizing agents of ozone, hydrogen peroxide and adducts thereof, halogen elements and thiosulfonates and organic oxidizing agents of quinones. It is preferred that reduction sensitization be carried out in combination with the oxidizing agents. After the oxidizing agents are used, reduction sensitization may be used. After chemical sensitization is carried out, the oxidizing agents may be used. Alternatively, chemical sensitization may be carried out simultaneously with the use of the oxidizing agents. These methods may be carried out in the stage of the formation of the grains or in the stage of chemical sensitization.

Gelatin can be advantageously used as a protective colloid used during the preparation of the emulsions of the present invention. However, other hydrophilic colloids can also be used. Examples of hydrophilic colloids which can be used in the present invention include proteins such as gelatin derivatives, graft polymers of gelatin with other high-molecular materials, albumin and casein; cellulose derivatives such as hydroxyethyl cellulose, carboxymethyl cellulose and cellulose sulfate; sugar derivatives such as sodium alginate and starch derivatives; and various synthetic hydrophilic high-molecular materials such as homopolymers, for example, polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole and copolymers thereof.

Examples of gelatins which can be used in the present invention include lime-processed gelatin, acid-processed gelatin, enzyme-processed gelatin (as described in *Bull. Soc. Sci. Photo. Japan*, No. 16, P30 (1966)), hydrolyzate of gelatin and enzymatic hydrolyzate of gelatin.

It is preferred that the emulsions of the present invention be washed with water to remove soluble salts and that the desalted emulsions be dispersed in fresh protective colloid. The washing temperature can be properly set according to purpose, but is preferably 5° to 50° C. The pH during washing can be properly set according to purpose, but is preferably 2 to 10, more preferably 3 to 8. The pAg during washing can be properly set according to purpose, but is preferably 5 to 10. Examples of washing methods include a noodle washing method, a dialysis method using a semipermeable membrane, a centrifugal method, a coagulation method and an ion exchange method. Examples of the coagulation method include a method using a sulfate, a method using an organic solvent, a method using a water-soluble polymer and a method using a gelatin derivative.

The sensitizing dyes may be added to the emulsions at such a stage that the sensitizing dyes are added simultaneously with the addition of the chemical sensitizing agents, as described in U.S. Pat. Nos. 3,628,969 and 4,225,666, before chemical sensitization, or before the completion of the formation of the precipitate of silver halide grains, and spectral sensitization may be commenced as described in JP-A-58-113928. The sensitizing dyes may be added portion-wise, that is, a part thereof may be added before chemical sensitization, and the remainder may be added after chemical sensitization as described in U.S. Pat. No. 4,225,666. The sensitizing dyes may be added at any stage during the course of the formation of the silver halide grains as described in, for example, U.S. Pat. No. 4,183,756.

It is essential that the sensitizing dyes be present during chemical sensitization.

The sensitizing dyes are generally used in an amount of $10^{-8}$ to $10^{-2}$ mol per mol of silver halide.

The coating weight of the light-sensitive silver halide of the present invention is generally from 1 mg to 10 $g/m_2$ in terms of silver.

Various anti-fogging agents or photographic stabilizers can be used in the present invention. Examples thereof include azoles and azaindenes as described in RD 17643 (1978) pp. 24 to 25, nitrogen-containing carboxylic acids or phosphoric acids as described in JP-A-59-168442, mercapto compounds and metal salts thereof as described in JP-A-59-111636 and acetylene compounds as described in JP-A-62-87957.

Additives which can be used in the present invention are fully described in *Research Disclosure* Item 17643 (1978), ibid., Item 18716 (November 1979) and ibid., Item 307105 (November 1989), and the places of the disclosures thereof are indicated in the following Table.

| Additive | RD17643 (Dec. '78) | RD18716 (Nov. '79) | RD307105 (Nov. '89) |
|---|---|---|---|
| 1. Chemical sensitizing agent | p. 23 | p. 648 right column (RC) | p. 866 |
| 2. Sensitivity increaser | | p. 648 right column (RC) | |
| 3. Spectral sensitizing agent, supersensiting agent | pp. 23–24 | p. 648 RC–p. 649 RC | pp. 866–868 |
| 4. Bleaching agent | p. 24 | p. 647 | p. 868 |
| 5. Antifogging agent, stabilizer | pp. 24–25 | p. 649 RC | pp. 868–870 |
| 6. Light absorbent, filter dye, ultraviolet light absorber | pp. 25–26 | p. 649 RC–p. 650 left column (LC) | p. 873 |
| 7. Anti-staining agent | p. 25 RC | p. 650 LC–RC | p. 872 |
| 8. Dye image stabilizer | p. 25 | p. 650 LC | p. 872 |
| 9. Hardening agent | p. 26 | p. 651 LC | pp. 874–875 |
| 10. Binder | p. 26 | p. 651 LC | pp. 873–874 |
| 11. Plasticizer, lubricant | p. 27 | p. 650 RC | p. 876 |
| 12. Coating aid, surfactant | pp. 26–27 | p. 650 RC | pp. 875–876 |
| 13. Antistatic agent | p. 27 | p. 650 RC | pp. 876–877 |
| 14. Matting agent | | | pp. 878–879 |

Now, the constituent elements of the present invention will be described below.

(A) Support

Examples of supports which can be used in the present invention include conventional photographic smooth supports such as transparent supports, white supports and black supports.

(B) Light-sensitive layer

Light-sensitive layers comprising a silver halide emulsion layer in combination with a dye image forming material are provided in the present invention. The constituent elements thereof will be illustrated below.

(1) Dye Image Forming Material

The dye image forming material (hereinafter referred to as a reducible dye providing compound) of the present invention is a compound which itself does not release a dye in connection with silver development, but releases a dye when reduced. The compound of this type is used in combination with an electron donor, and can release imagewise a diffusing dye by the reaction with the remainder of the electron donor after being imagewise oxidized by silver development. Examples of atomic groups having this function are described in U.S. Pat. Nos. 4,183,753, 4,142,891, 4,278,750, 4,139,379 and 4,218,368, JP-A-53-110827, U.S. Pat. Nos. 4,278,750, 4,356,249 and 4,358,525, JP-A-53-110827, JP-A-54-130927, JP-A-56-164342, U.S. Pat. No. 4,783,396, Kokai Giho 87-6199 and European Patent Laid-Open No. 220,746 A2.

Reducible dye providing compounds which can be used in the present invention are preferably compounds represented by the following general formula (I):

$$\text{PWR-}(Time)_t\text{-Dye} \qquad (I)$$

wherein PWR represents a group which releases -(Time)$_t$-Dye when reduced; Time represents a group which releases Dye through subsequent reactions after -(Time)$_t$-Dye is released from PWR; t represents an integer of 0 to 1; and Dye represents a dye or a precursor thereof.

Examples of PWR which can be used in the present invention are described in JP-A-3-63648(line 5 from the bottom of the lower right column of page 8 to line 6 from the top of the upper right column of page 9).

Among the compounds of general formula (I), it is preferred to use compounds having an N-X bond (wherein X is an oxygen atom, a nitrogen atom or a sulfur atom) and an electron attractive group in the molecule as described in European Patent 220,746 A2, Kokai Giho 87-6199, JP-A-62-244048, JP-A-63-201653 and JP-A-63-201654; compounds having an $SO_2$-X bond (wherein X is as defined above) and an electron attractive group in the molecule as described in JP-A-1-26842; compounds having a C—X' bond (wherein X' has the same meaning as X as defined above or is -$SO_2$-) and an electron attractive group in the molecule as described in JP-A-63-271341;and compounds having an O=P—X bond (wherein X is as defined above) and an electron attractive group in the molecule as described in JP-A-63-271344.

The above-described N-X bond type compounds are particularly preferred.

Further, compounds can be used which release a diffusing dye by the cleavage of a single bond by a bond conjugated with an electron accepting group after reduction as described in JP-A-1-161237and JP-A-1-61342.

Other preferred examples of the compounds of general formula (I) include those described in JP-A-3-3648 (line 16 of the right upper column of page 9 to line 12 of the left lower column of page 10 and line 10 to line 15 of the right lower column of page 10).

Time is a group which release Dye through subsequent reactions caused by the cleavage of a nitrogen-to-oxygen bond, a nitrogen-to-nitrogen bond or a nitrogen-to-sulfur bond.

Many groups represented by Time are known. Examples of the group represented by Time include those described in JP-A-61-147244 (pages 5 to 6), JP-A-61-36549 (pages 8 to 14) and JP-A-62-215270.

In formula (I), Dye may be a dye or a dye precursor which can be converted into a dye in the photographic processing stage or in a subsequent processing stage. The final image dye may be metal-chelated or not metal-chelated. Typical examples of suitable dyes include metal-chelated dyes and non-metal-chelated dyes such as azo dyes, azomethine dyes, anthraquinone dyes and phthalocyanine dyes. Among them, azo type cyan, magenta and yellow dyes are particularly useful.

Examples of the yellow dyes include those described in U.S. Pat. Nos. 3,597,200, 3,309,199, 4,013,633, 4,245,028, 4,156,609, 4,139,383, 4,195,992, 4,148,641, 4,148,643 and 4,336,322,JP-A-51-114930, JP-A-56-71072, Research Disclosure No. 17630 (1978) and ibid., 16475 (1977)

Examples of the magenta dyes include those described in U.S. Pat. Nos. 3,453,107, 3,544,545, 3,932,380, 3,931,144, 3, 932,308, 3,954,476, 4,233,237, 4,255,509, 4,250,246, 4,142,891, 4,207,104 and 4,287,292, JP-A-52-106727, JP-A-53-23628, JP-A-55-36804, JP-A-56-73057, JP-A-56-71060and JP-A-55-134.

Examples of the cyan dyes include those described in U.S. Pat. Nos. 3,482,972, 3,929,760, 4,013,635, 4,268,625, 4,171,220, 4,242,435, 4,142,891, 4,195,994, 4,147,544and 4,148,642, U.K. Patent 1,551,138, JP-A-54-99431, JP-A-52-8827, JP-A-53-47823, JP-A-53-143323, JP-A-54-99431, JP-A-56-71061, European Patents (EPC) 53,037and 53,040, *Research Disclosure* No. 17630(1978) and ibid., 16475(1977).

As a dye precursor, there can be used a nondiffusing dye providing compound having a dye bonded thereto, the absorption spectrum of the dye being temporarily shifted during the storage and exposure of the light-sensitive material. The term "a dye whose absorption spectrum is temporarily shifted" (hereinafter referred to as a temporarily shifted dye) as used herein means a dye whose absorption spectrum is changed to a different one from its original absorption spectrum when observed as an image. The shifted spectrum may be restored to the original absorption spectrum simultaneously with the release of the dye from the nondiffusing dye providing compound or independently of the release during development. Alternatively, the shifted dye may be restored to the original absorption spectrum after the dye reaches an image receiving layer after the diffusion of the dye.

Examples of usable temporarily shifted dyes include yellow, magenta, cyan and black dyes. From the viewpoint of structural classification, the dyes include nitro and nitroso dyes, azo dyes (e.g., benzeneazo dyes, naphthaleneazo dyes, heterocyclic azo dyes), stilbene dyes, carbonium dyes (e.g., diphenylmethane dyes, triphenylmethane dyes, xanthene dyes, acridine dyes), quinoline dyes, methine dyes (e.g., polymethine dyes, azomethine dyes), thiazole dyes, quinoneimine dyes (e.g., azine dyes, oxazine dyes, thiazine dyes), lactone dyes, amionoketone dyes, hydroxyketone dyes, anthraquinone dyes, indigo dyes, thioindigo dyes and phthalocyanine dyes. Preferred dyes as temporarily shifted dyes are azo dyes, carbonium dyes, anthraquinone dyes, methine dyes and quinoneimine dyes with azo dyes being particularly preferred.

Examples of methods for forming the temporarily shifted dyes which can be used in the present invention include a method wherein a dye is converted into a two electron reductant to thereby cause the hypsochromic shift of the original absorption spectrum, and oxidation is carried out during or after development to restore the shifted spectrum to the original absorption spectrum (azo dyes, anthraquinone dyes, methine dyes, quinoneimine dyes, indigo dyes); a method wherein an auxochrome is chemically blocked to thereby cause the hypsochromic shift of the original absorption spectrum, and deblocking is carried out during development to restore the shifted spectrum to the original absorption spectrum (chemical blocking method) (azo dyes, carbonium dyes, methine dyes); and a method wherein after a dye reaches an image receiving layer, the dye is chelated with a metal ion to thereby convert it into a dye having a desired absorption spectrum (after-chelating method) (azo dyes, methine dyes, phthalocyanine dye). The chemical blocking method and after-chelating method are preferred in the present invention.

In connection with these methods, examples of a method wherein the release of the dye and deblocking independently take place in the method wherein an auxochrome is chemically blocked are described in JP-A-57-158638, JP-A-55-53329 and JP-A-55-53330. Examples of other blocking methods described as general methods include those described in U.S. Pat. Nos. 4,009,029, 4,310,612, 3,674,478, 3,932,480, 3,993,661, 4,335,200, 4,363,865 and 4,410,618. An example of a method wherein the release of the dye and deblocking take place simultaneously is described in U.S. Pat. No. 4,783,996. Examples of the method wherein after a dye reaches the dye receiving layer, the dye is chelated with a metal ion to thereby convert it into a dye having a desired absorption spectrum, are described in JP-A-58-209742, JP-A-58-209741, JP-A-58-17438, JP-A-58-17437, JP-A-58-17436, JP-A-57-185039, JP-A-57-58149, U.S. Pat. Nos. 4,204,993, 4,148,642 and 4,147,544, JP-A-57-158637, JP-A-58-123537, JP-A-57-181546, JP-A-60-57837, JP-A-57-182738, JP-A-59-208551, JP-A-60-37555, JP-A-59-15448, JP-A-59-149362and JP-A-59-164553.

Typical examples of the reducible dye providing compounds which can be used in the present invention include, but are not limited to, the following compounds. For example, the dye providing compounds described in U.S. Pat. No. 4,783,396, European Patent Laid-Open No. 220,746A2 and Kokai Giho 87-6199 can also be used.

(1)
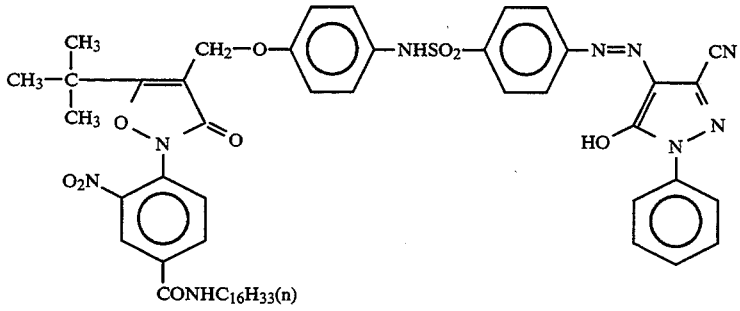
(2)
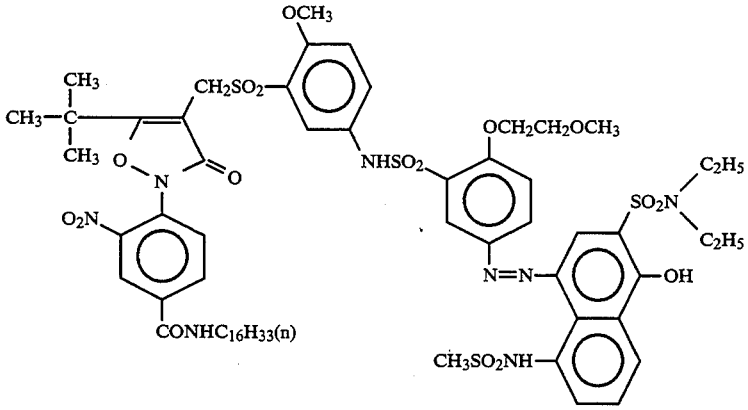
(3)
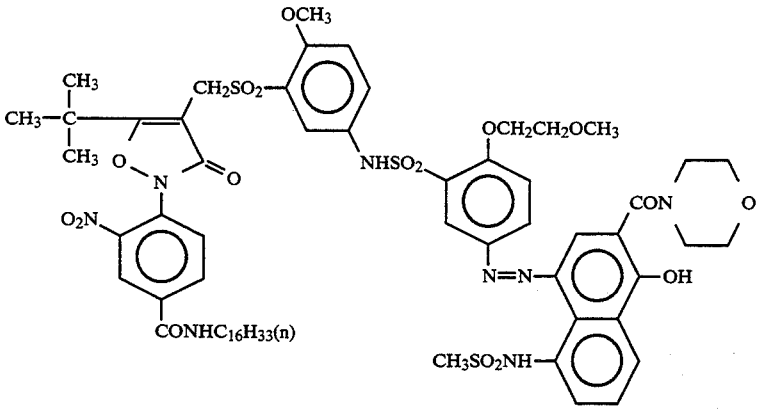
(4)
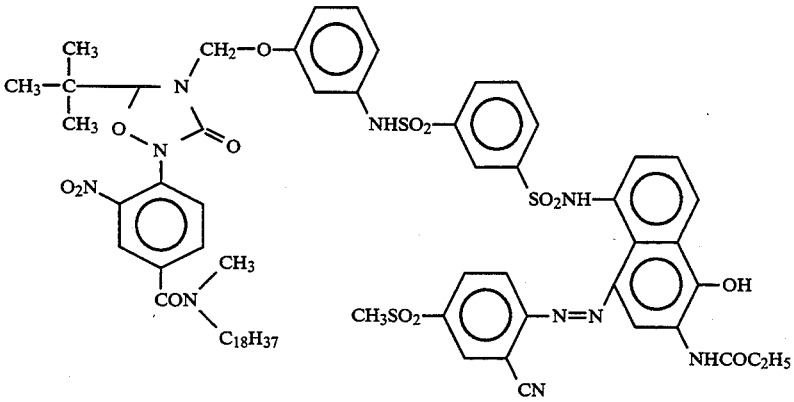

-continued
(5)
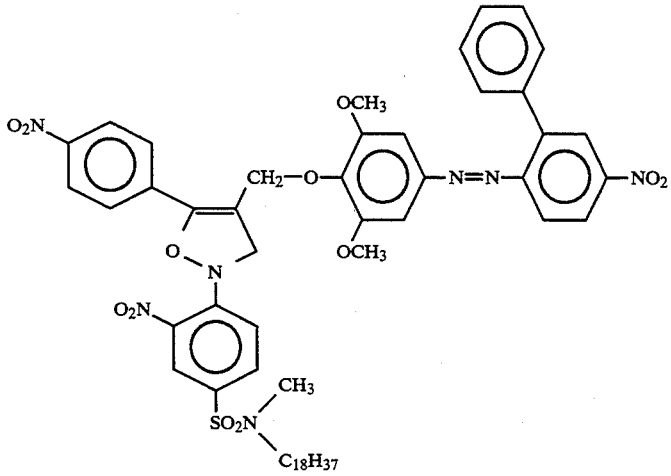
(6)
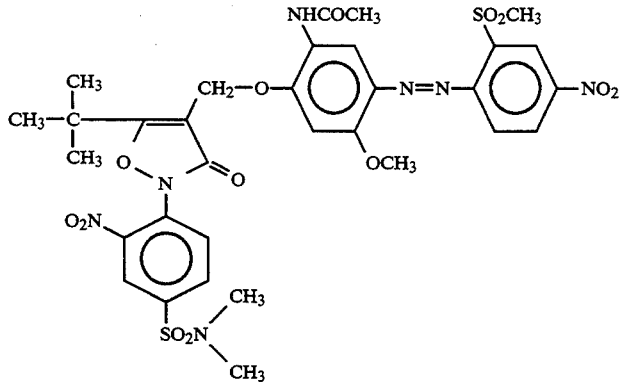
(7)
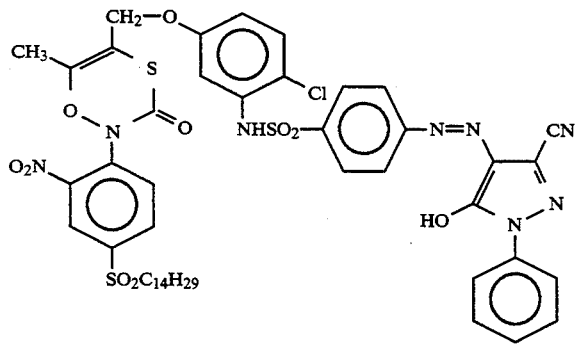
(8)
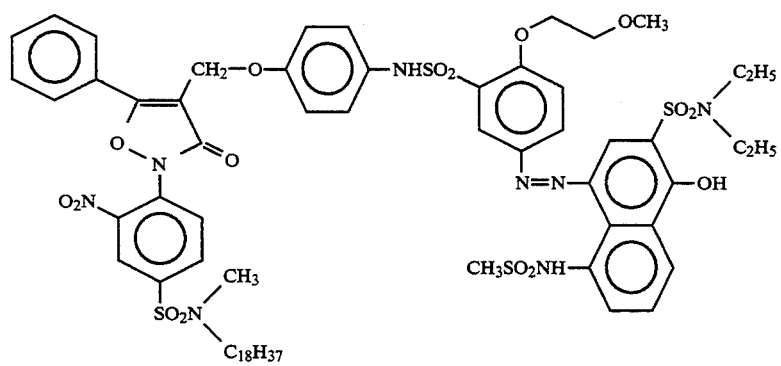

-continued
(9)
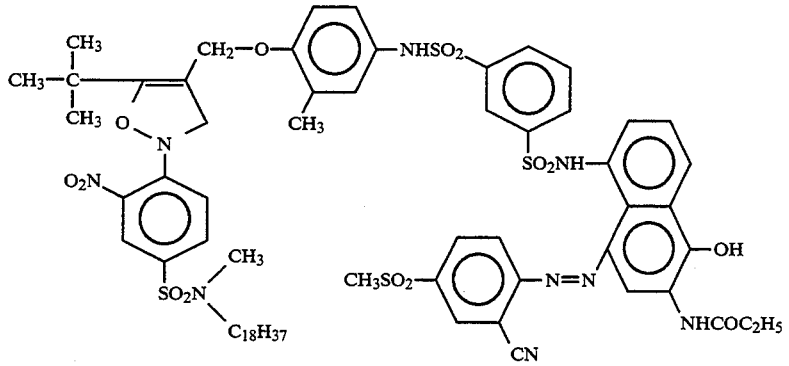
(10)
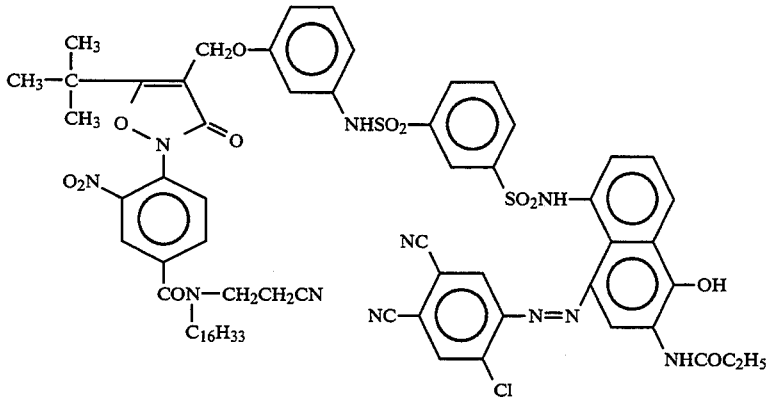
(11)
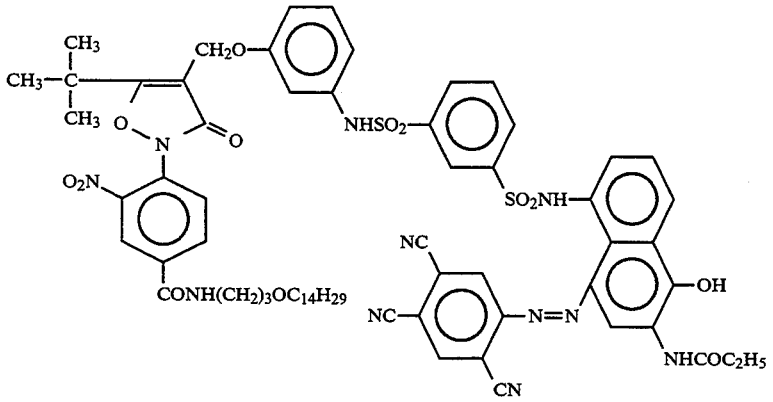
(12)
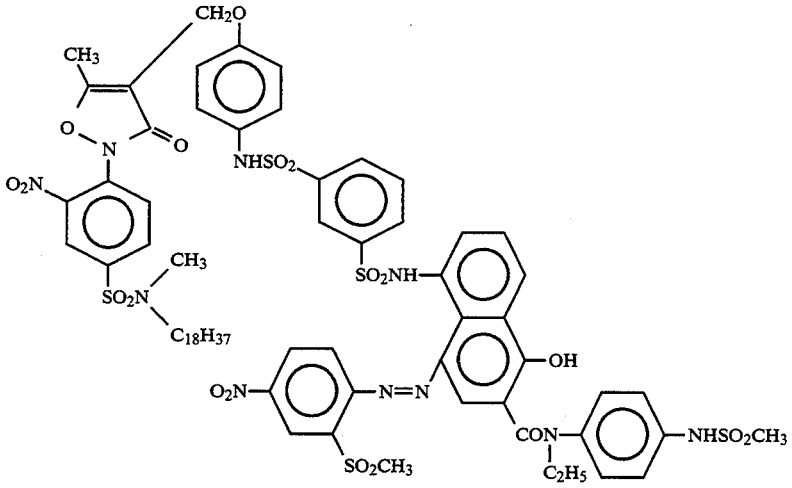

-continued
(13)
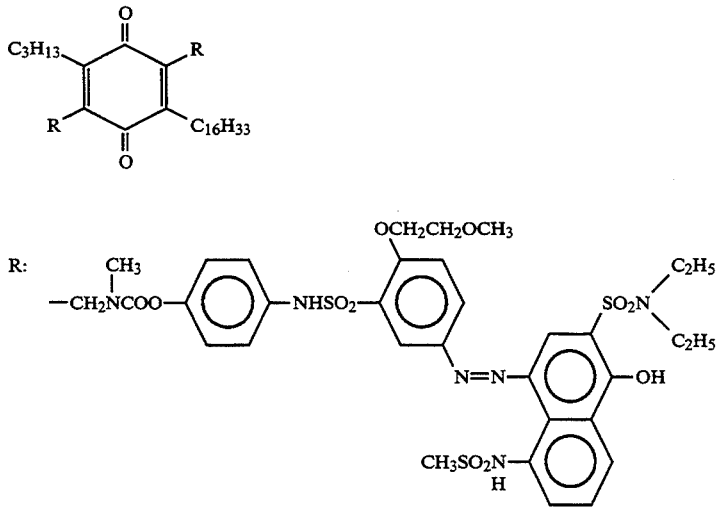
(14)
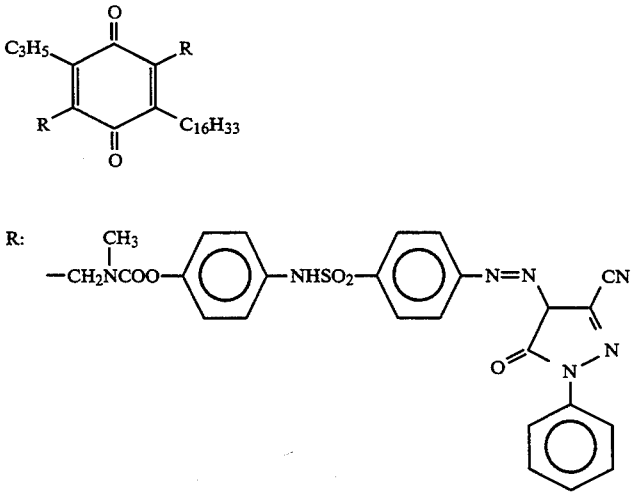
(15)
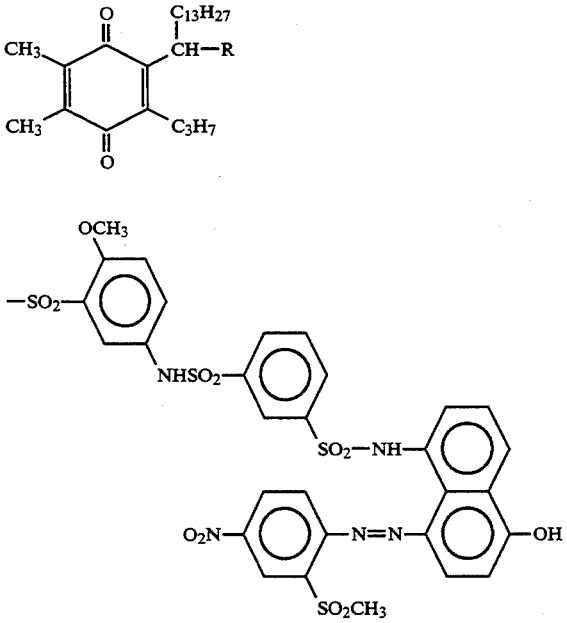

-continued (16)

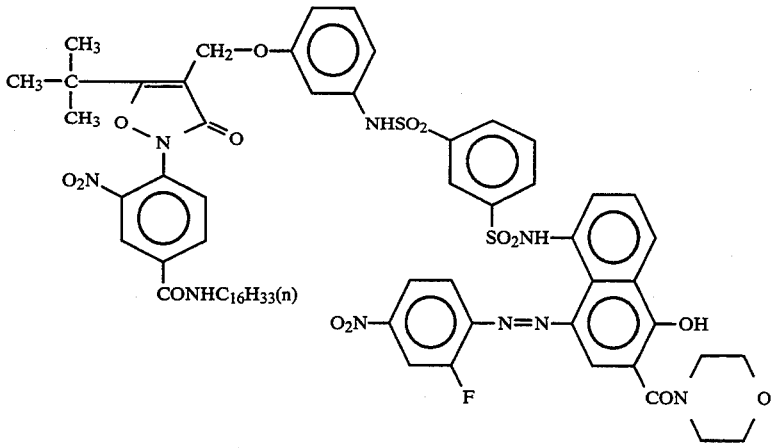

These compounds can be synthesized by the methods described in the patent specifications cited hereinbefore.

The reducible dye providing compounds are generally used in an amount of 0.05 to 5 mmol/m$^2$, preferably 0.1 to 3 mmol/m$^2$, though the amount varies depending on the extinction coefficients of the dyes.

The dye providing compounds may be used either alone or in a combination of two or more of them. A mixture of two or more dye providing compounds having mobile dyes having different hues can be used to obtain an image having a black hue or a different hue, for example, by containing a mixture of at least one cyan dye providing compound, at least one magenta dye providing compound and at least one yellow dye providing compound in a silver halide-containing layer or a layer adjacent thereto, as described in JP-A-60-162251.

(2) Electron Donor

In the present invention, electron donors (the term "electron donor" as used herein includes an electron donor as well as a precursor thereof) are used. The details of these compounds are described in U.S. Pat. No. 4,783,396, European Patent Laid-Open No. 220,746A2 and Kokai Giho 87-6199. Particularly preferred electron donors are compounds represented by the following general formulas (SI) and (SII):

(SI)

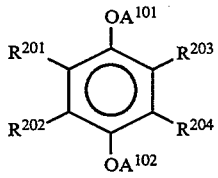

(SII)

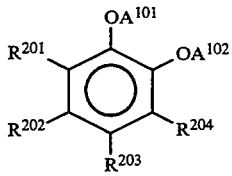

In general formulas (SI) and (SII), $A^{101}$ and $A^{102}$ each represents a hydrogen atom or a protective group for a phenolic hydroxyl group, the protective group being capable of being removed by a nucleophilic reagent.

Examples of the nucleophilic agent include anionic reagents such as $OH^-$, $RO^-$ (wherein R is an alkyl group, an aryl group, etc.), hydroxamic acid anion and $SO_3^{-2}$ and compounds having non-conjugated electron-pairs such as primary or secondary amines, hydrazine, hydroxylamines, alcohols and thiols.

When $A^{101}$ and $A^{102}$ in general formulas (SI) and (SII) each represents a group capable of being removed by an alkali (hereinafter referred to as a precursor group), preferred examples of the group include hydrolyzable groups such as an acyl group, an alkoxycarbonyl group, an aryloxycarbonyl group, a carbamoyl group, an imidoyl group, an oxazolyl group and a sulfonyl group; precursor groups of a type which utilize a reverse Michael reaction as described in U.S. Pat. No. 4,009,029; precursor groups of a type which utilize, as an intramolecular nucleophilic group, an anion formed after a ring cleavage reaction as described in U.S. Pat. No. 4,310,612; precursor groups wherein an anion electronically migrates through a conjugated system to thereby cause a cleavage reaction as described in U.S. Pat. Nos. 3,674,478, 3,932,480 and 3,993,661; precursor groups wherein a cleavage reaction takes place by the electron migration of an anion reacted after a ring cleavage reaction as described in U.S. Pat. No. 4,335,200; and precursor groups which utilize an imidomethyl group as described in U.S. Pat. Nos. 4,363,865 and 4,410,618.

$A^{101}$ or $A^{102}$ may be combined together with $R^{201}$, $R^{202}$, $R^{203}$ or $R^{204}$ to form a ring, if possible. $A^{101}$ and $A^{102}$ may be the same or different.

$R^{201}$, $R^{202}$, $R^{203}$ and $R^4$ and each represents a hydrogen atom, an alkyl group, an aryl group, an alkylthio group, an arylthio group, a sulfonyl group, a sulfo group, a halogen atom, a cyano group, a carbamoyl group, a sulfamoyl group, an amido group, an imido group, a carboxyl group or a sulfonamido group. These groups may optionally have one or more substituent groups.

The sum total of carbon atoms in $R^{201}$ to $R^{204}$ is at least 8. In general formula (SI), $R^{201}$ and $R^{202}$ and/or $R^{203}$ and $R^{204}$ may be combined together to form a saturated or unsaturated ring. In general formula (S11), $R^{201}$ and $R^{202}$ $R^{202}$ and $R^{203}$ and/or $R^{203}$ and $R^{204}$ may be combined together to form a saturated or unsaturated ring.

Among the electron donors of general formulas (SI) and (SII), compounds where at least two of $R^{201}$ to $R^{204}$ are each a substituent group other than hydrogen are preferred. Particularly preferred are compounds where at least one of $R^{201}$ and $R^{202}$ and at least one of $R^{203}$ and $R^{204}$ are each a substituent group other than hydrogen.

The electron donors may be used either alone or in a combination of two or more of them. Further, one or more of the electron donors may be used in combination with one or more of the precursors thereof.

Examples of the electron donors which can be used in the present invention include, but are not limited to, the following compounds.

(ED-1)

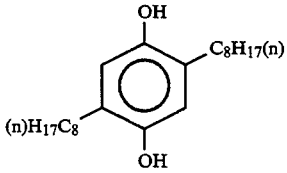

(ED-2)

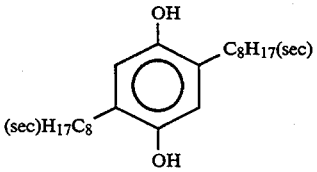

(ED-3)

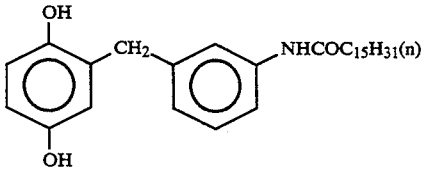

(ED-4)

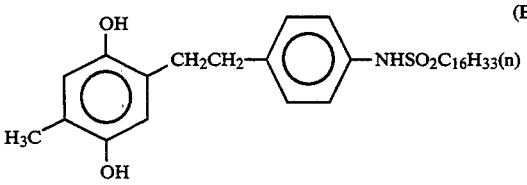

(ED-5)

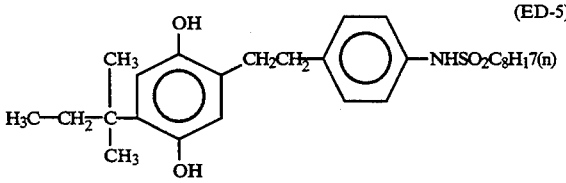

(ED-6)

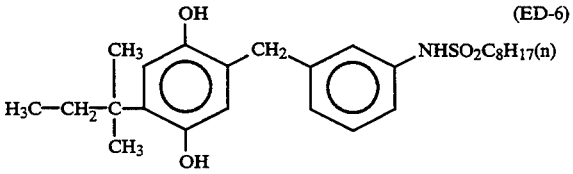

(ED-7)

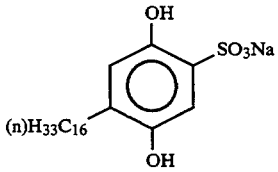

-continued (ED-8)

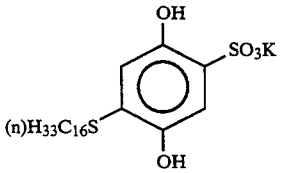

(ED-9)

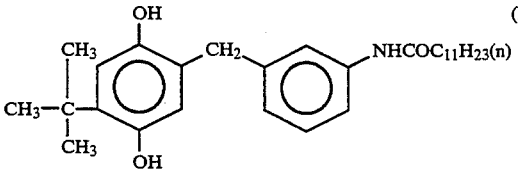

(ED-10)

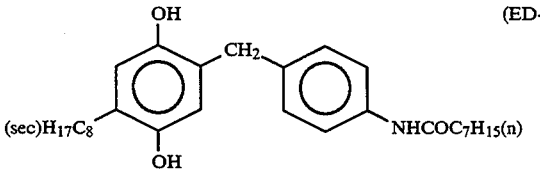

(ED-11)

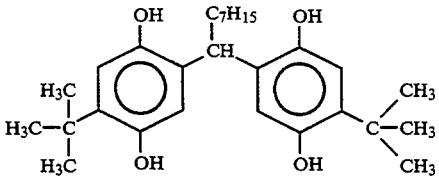

(ED-12)

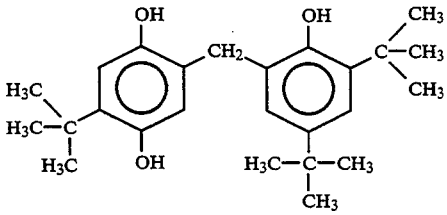

(ED-13)

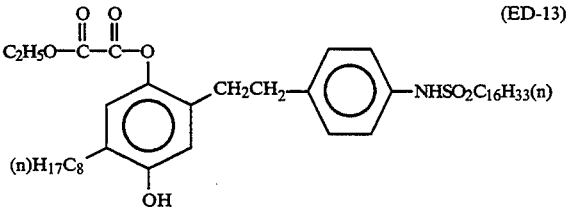

(ED-14)

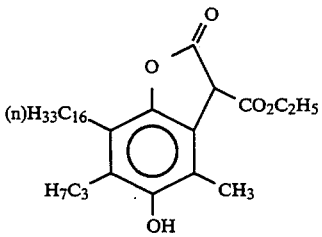

(ED-15)

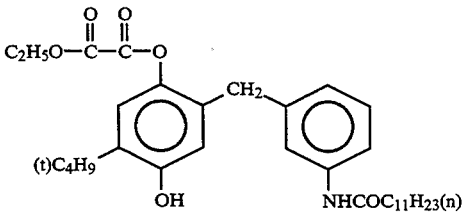

The amount of the electron donors to be used can be widely varied. Generally, the electron donors are used in an amount of preferably 0.01 to 50 mol, particularly preferably 0.1 to 5 mol per mol of the positive dye providing compound and in amount of 0.001 to 5 mol, preferably 0.01 to 1.5 mol per mol of silver halide.

(3) Interlayer

It is desirable that a diffusing electron transfer agent be used as a reducing agent in addition to the nondiffusing electron donor to inhibit the staining of the light-sensitive material containing the reducible dye providing compound for use in forming a positive image. However, a problem may occur in that the thus-formed electron transfer agent radical may diffuse into other layers having different color sensitivities and cross-oxidize the electron donor contained in these other layers, further accelerating fog development, lowering the density of the image, and, as a result, degrading the color reproducibility.

To solve this problem, an interlayer may be provided between light-sensitive layers having different color sensitivities from each other, or a reducible nondiffusing reducing agent may be incorporated in the interlayer.

Examples of suitable nondiffusing reducing agents include nondiffusing hydroquinones, sulfonamidophenols, and sulfonamidonaphthols. Specific examples thereof are described in JP-B-50-21249, JP-B-50-23819 JP-A-49-106326, JP-A-49-129535, U.S. Pat. Nos. 2,336,327, 2,360,290, 2,403,721, 2,544,640, 2,732,300, 2,782,659, 2,937,086, 3,637,393 and 3,700,453, U.K. Patent 557,750, JP-A-57-24941 and JP-A-58-21249. Methods of dispersing these compounds are described in JP-A-60-238831and JP-B-60-18978.

The amount of the compound to be used for each interlayer is generally from 0.05 to 50 mmol per $m_2$ of the support and generally from 0.01 to 50 mmol per gram of the binder.

Methods for adding the nondiffusing reducing agents to the interlayer include an oil dispersion method, a polymer dispersion method and a fine particle dispersion method. Any of these methods may be used.

Examples of the binder which can be used in the interlayer of the present invention include natural materials such as gelatin, gelatin derivatives, cellulose derivatives, polysaccharides (e.g., dextran) and gum arabic and water-soluble polymers such as polyvinyl acetals (preferably the degree of acetalization being not higher than 20%, such as polyvinyl butyral), polyacrylamides, polyvinyl pyrrolidones, ethyl cellulose and polyvinyl alcohols (preferably the degree of saponification being not lower than 75%).

If desired, these binders may be used in a combination of two or more of them.

The interlayer of the present invention may contain solid particles. Examples of the solid particles which can be used in the present invention include white pigments such as titanium dioxide, zinc oxide, calcium oxide, calcium carbonate, magnesium carbonate, barium sulfate, aluminum oxide and silicon dioxide, black pigments such as carbon black and other inorganic and organic color pigments.

Further, metallic powders such as ferrite, aluminum powder, copper powder and graphite powder can be used.

Furthermore, polymer particles can be used as solid particles to be contained in the interlayer of the present invention.

If desired, solid particles may be used in a combination of two or more of them.

The solid particles typically have an average particle size of 0.005 to 1.0 μm, preferably 0.01 to 0.5 μm.

The amount of the solid particles to be incorporated in the interlayer of the present invention is preferably not less than 5% by weight, more preferably 20 to 100% by weight based on the amount of the binder contained in the interlayer.

(4) Addition Method

The dye providing compound, electron donor or precursor thereof and other hydrophobic additives employed in the practice of the present invention can be introduced into the hydrophilic colloid layers, for example, by using high-boiling organic solvents and the method described in U.S. Pat. No. 2,322,027, or by dissolving them in an organic solvent having a boiling point of 30 to 160° C. (e.g., a lower alkyl acetate such as ethyl acetate or butyl acetate, ethyl propionate, sec-butyl alcohol, methyl isobutyl ketone, B-ethoxyethyl acetate, methyl cellosolve acetate or cyclohexanone) and dispersing the resulting solution in the hydrophilic colloid. Examples of suitable high-boiling organic solvents include alkyl phthalates (e.g., dibutyl phthalate, dioctyl phthalate), phosphoric esters (e.g., diphenyl phosphate, triphenyl phosphate, tricyclohexyl phosphate, tricresyl phosphate, dioctyl butyl phosphate), citric esters (e.g., tributyl acetylcitrate), benzoic esters (e.g., octyl benzoate), alkylamides (e.g., diethyllaurytamide), fatty acid esters (e.g., dibutoxyethyl succinate, dioctyl azelate), trimesic esters (e.g., tributyl trimesate), carboxylic acids (e.g., those described in JP-A-63-85633) and the compounds described in JP-A-59-83154, JP-A-59-178451, JP-A-59-178452, JP-A-59-178453, JP-A-59-178454, JP-A-59-178455, and JP-A-59-178457. A mixture of a high-boiling organic solvent and a low-boiling organic solvent may be used. Further, after dispersion, the low-boiling organic solvent may optionally be removed by ultrafiltration.

The high-boiling organic solvents are generally used in an amount of not more than 10 g, preferably not more than 5 g per gram of the dye providing compound, generally in an amount of not more than 5 g, preferably not more than 2 g per gram of the non-diffusing reducing agent and generally in an amount of not more than one gram, preferably not more than 0.5 g, still more preferably not more than 0.3 g per gram of the binder.

Dispersion methods using polymers as described in JP-B-51-39853 and JP-A-51-59943 can be used.

Further, the compounds of the present invention can be directly dispersed in the emulsions, or after they are dissolved in water or an alcohol, the resulting solution can be dispersed in gelatin or the emulsions.

When the compounds are substantially insoluble in water, the compounds in the form of fine particles can be dispersed in gelatin (see e.g., the methods described in JP-A-59-174830, JP-A-53-102733, JP-A-63-271339).

When hydrophobic materials are dispersed in the hydrophilic colloid, various surfactants can be used. Examples of the surfactants include those described in JP-A-59-157636(pp. 37 to 38).

(5) Silver Halide Emulsion

Silver halide emulsions already described hereinbefore can be used in the present invention. (6) Constitution of light-sensitive layer For the reproduction of a natural color by subtractive color photography, at least combination unit of an emulsion spectrally sensitized with the abovedescribed spectral sensitizing dye and the above-described dye image forming material capable of providing a dye having selective spectral absorption in the same wavelength range as that of the sensitizing dye is utilized in the present invention. The emulsion and the dye image forming material may be coated as separate layers, or they may be mixed and coated as a single layer. When the dye image forming material in the coated state has an absorption in the spectral sensitivity region of the emulsion combined therewith, it is preferred that they be coated as separate layers. In this case, it is preferred from the viewpoint of sensitivity that the layer containing the reducible dye providing compound be provided under the silver halide emulsion layer. The emulsion layer may be composed of two or more emulsion layers having different sensitivities. An auxiliary layer may be provided between the emulsion layer and the dye image forming material layer. A barrier layer as described in JP-B-60-15267 may be provided to increase the density of the dye image, or a reflection layer described in JP-A-60-91354 may be provided to increase the sensitivity of the light-sensitive element.

In a preferred embodiment of a multi-layer structure, the layers are arranged in the order of a blue-sensitive emulsion combination unit, a green-sensitive emulsion combination unit and a red-sensitive emulsion combination unit from the exposure side.

When the present invention is applied to photographing materials, an ultraviolet light absorbing layer can be provided as the uppermost layer of the light-sensitive layers. The UV light absorbing layer may contain ultraviolet absorbers which are conventionally used in the field of photography, such as benztriazole compounds, 4-thiazolidone compounds and benzophenone compounds.

(c) Dye Receiving Layer

The dye receiving layer of the present invention contains a mordant contained in a hydrophilic colloid. The dye receiving layer may be composed of a single layer or a multi-layer structure where mordants having different mordanting powers are coated in layers. The details thereof are described in JP-A-61-252551. Polymer mordants are preferred.

Examples of the polymer mordants which can be used in the present invention include polymers having a sec-amino group or a tert-amino group, polymers having a nitrogen-containing heterocyclic moiety and polymers having a quaternary cation group thereof. These polymers have a molecular weight of generally not less than 5,000, preferably not less than 10,000.

Specific examples of the mordant include vinylpyridine polymers and vinylpyridinium cation polymers as described in U.S. Pat. Nos. 2,548,564, 2,484,430, 3,148,061 and 3,756,814; vinylimidazolium cation polymers as described in U.S. Pat. No. 4,124,386; polymer mordants capable of crosslinking with gelatin, etc. as described in U.S. Pat. Nos. 3,625,694, 3,859,096 and 4,128,538 and U.K. Patent 1,277,453; aqueous sol type mordants as described in U.S. Pat. Nos. 3,958,995, 2,721,852 and 2,798,063, JP-A-54-115228, JP-A-54-145529, JP-A-54-126027, JP-A-54-155835 and JP-A-56-17352; water-insoluble mordants as described in U.S. Pat. No. 3,898,088; reactive mordants capable of forming a covalent bond with a dye as described in U.S. Pat. Nos. 4,168,976 and 4,201,840; and mordants as described in U.S. Pat. Nos. 3,709,690, 3,788,855, 3,642,482, 3,488,706, 3,557,066, 3,271,147 and 3,271,148, JP-A-53-30328, JP-A-52-155528, JP-A-53-125, JP-A-53-1024, JP-A-53-107835 and U.K. Patent 2,064,802.

Further, the mordants described in U.S. Pat. Nos. 2,675,316 and 2,882,156 can be used.

Among them, mordants which difficultly migrate from a mordant layer to other layers are preferred. For example, mordants capable of crosslinking with a matrix such as gelatin, water-insoluble mordants and aqueous sol (or latex dispersion) type mordants are preferred. Particularly preferred are latex dispersion type mordants having a particle size of 0.01 to 2 μm, preferably 0.05 to 0.2 μm.

The coating weight of the mordant varies depending on the type of the mordant, the content of quaternary cation groups, the types and amounts of the dyes to be mordanted and the types of the binders, but the coating weight is preferably 0.5 to 10 g/m$^2$, more preferably 1.0 to 5.0 g/m$^2$, particularly preferably 2 to 4 g/m$^2$.

Examples of hydrophilic colloids which can be used in the image receiving layer include gelatin, polyvinylalcohol, polyacrylamide and polyvinyl pyrrolidone. Among them, gelatin is preferred.

The image receiving layer may contain antifading agents. Examples of suitable anti-fading agents include antioxidants, ultraviolet light absorbers and certain metal complexes. These compounds are substantially contained in the image receiving layer. However, the anti-fading agents may be added to other layers, so long as an anti-fading effect can be obtained.

Examples of suitable antioxidants include chroman compounds, coumaran compounds, phenol compounds (e.g., hindered phenols), hydroquinone derivatives, hindered amine derivatives and Spiro-indane compounds. Further, the compounds described in JP-A-61-159644 are effective.

Examples of suitable ultraviolet light absorbers include benztriazole compounds as described in U.S. Pat. No. 3,533,794, 4-thiazolidone compounds as described in U.S. Pat. No. 3,352,681, benzophenone compounds as described in JP-A-46-2784 and the compounds described in JP-A-54-48535, JP-A-62-136641 and JP-A-61-88256. Further, ultraviolet light absorbing polymers as described in JP-A-62-260152 are effective.

Examples of suitable metal complexes include the compounds described in U.S. Pat. Nos. 4,241,155, 4,245,018 (3rd to 36th columns) and 4,254,195 (3rd to 8th columns), JP-A-62-174741, JP-A-61-88256 (pp. 27 to 29), JP-A-1-75568 and JP-A-63-199248.

Examples of useful anti-fading agents are described in JP-A-62-215272 (pp. 125 to 137).

The anti-fading agent may be previously contained in the image receiving element to prevent a dye which is transferred to the image receiving element from fading. Alternatively, the anti-fading agent may be introduced to the image receiving element from an external source such as the light-sensitive element or a processing composition.

The above-described antioxidants, ultraviolet light absorbers and metal complexes may be used in combination.

The light-sensitive element or the image receiving element may contain a fluorescent brightener. It is particularly preferred that the fluorescent brightener be incorporated in the image receiving element, or be introduced into the image receiving layer from the light-sensitive element or a processing composition during processing by previously incorporating the fluorescent brightener in the light-sensitive element or the processing composition. Examples of suitable fluorescent brighteners include the compounds described in K. Veenkataraman, The Chemistry of Synthetic Dyes, Vol. V, Chapter 8 and JP-A-61-143752. More specifically, examples of suitable fluorescent brighteners include stilbene compounds, coumarin compounds, biphenyl compounds, benzoxazolyl compounds, naphthalimide compounds, pyrazoline compounds and carbostyryl compounds.

The fluorescent brightener may be used in combination with an anti-fading agent. (D) Layer having a neutralization function A layer having a neutralization function is a layer which contains a sufficient amount of an acid material to neutralize any alkali material carried over from the processing composition. If desired, the layer may be composed of a multi-layer structure comprising a neutralization rate controlling layer (timing layer) and an adhesion strengthening layer. Preferred acid materials are substances having an acid group having a pKa of not higher than 9 (or a precursor group which gives such an acid group by hydrolysis). More preferred acid materials include higher fatty acids such as oleic acid as described in U.S. Pat. No. 2,983,606; polymers of acrylic acid, methacrylic acid or maleic acid and partial esters thereof or acid anhydrides thereof as described in U.S. Pat. No. 3,362,819; copolymers of acrylic acid with acrylic esters as described in French Pat. No. 2,290,699; and latex type acid polymers as described in U.S. Pat. No. 4,139,383 and Research Disclosure No. 16102 (1977).

Other examples thereof include acid materials as described in U.S. Pat. No. 4,088,493, JP-A-52-153739, JP-A-53-1023, JP-A-53-4540, JP-A-53-4541, and JP-A-53-4542.

Examples of suitable acid polymers include copolymers of a vinyl monomer such as ethylene, vinyl acetate or vinyl methyl ether with maleic anhydride, copolymers of n-butyl ester or butyl acrylate with acrylic acid, cellulose acetate and hydrogen-phthalates.

The polymer acids may be used alone or in combination with hydrophilic polymers. Preferred examples of such hydrophilic polymers include polyacrylamide, polyvinylpyrrolidone, polyvinyl alcohol (including partial saponified products), carboxymethyl cellulose, hydroxymethyl cellulose, hydroxyethyl cellulose and polymethyl vinyl ether. Among them, polyvinyl alcohol is preferred.

The polymer acids may be mixed with polymers other than hydrophilic polymers, such as cellulose acetate.

The coating weight of the polymer acid is a function of the amount of the alkali to be spread over the light-sensitive element. The equivalent ratio of the polymer acid to the alkali per unit area is preferably 0.9 to 0.2.

When the amount of the polymer acid is too small, disadvantages are caused in that the hue of the transferred dye is changed and stain is formed on the white area, while when the amount thereof is too large, disadvantages are caused in that the hue is changed and light resistance is lowered. A more preferred equivalent ratio is 1.0 to 1.3. In the case of a mixture of the polymer acid and a hydrophilic polymer, the quality of the resulting photograph is deteriorated when the amount of the hydrophilic polymer is either too small or too large. The ratio by weight of the hydrophilic polymer to the polymer acid is generally from 0.1 to 10, preferably 0.3 to 3.0.

Additives can be incorporated in the layer having a neutralization function for various purposes. For example, the layer may contain conventional hardening agents to harden the layer. The layer may contain a polyhydric compound such as polyethylene glycol, polypropylene glycol or glycerin to improve the brittleness of the layer. If desired, other additives such as an antioxidant, a restrainer and precursors thereof may be added.

(E) Neutralization timing layer

Useful materials which may be used to form a timing layer to be used in combination with the neutralization layer include polymers which reduce alkali permeability such as gelatin, polyvinyl alcohol, partial acetalized products of polyvinyl alcohol, cellulose acetate and partially hydrolized polyvinyl acetate; latex polymers which increase the activated energy of alkali permeation, prepared by copolymerizing a small amount of a hydrophilic comonomer such as acrylic acid monomer; and polymers having a lactone ring.

Particularly useful are timing layers using cellulose acetate as described in JP-A-54-136328, U.S. Pat. Nos. 4,267,262, 4,009,030 and 4,029,849; latex polymers prepared by copolymerizing a small amount of hydrophilic comonomer such as acrylic acid as described in JP-A-54-128335, JP-A-56-69629, JP-A-57-6843, U.S. Pat. Nos. 4,056,394, 4,061,496, 4,199,362, 4,250,243, 4,256,827 and 4,268,604; polymers having a lactone ring as described in U.S. Pat. No. 4,229,516; and polymers as described in JP-A-56-25735, JP-A-56-97346, JP-A-57-6842, European Patents 31,957A1, 37,724A1 and 48,412A1.

The neutralization timing layer may be composed of a single layer structure or a multi-layer structure comprising two or more layers.

In the timing layer comprising the above material, there can be incorporated a restrainer and/or a precursor thereof as described in U.S. Pat. No. 4,009,029, West German Patent Laid-Open (OLS) Nos. 2,913,164 and 3,014,672, JP-A-54-155837 and JP-A-55-138745; hydroquinone precursors as described in U.S. Pat. No. 4,201,578; and other useful photographic additives and precursors thereof.

(F) Release Layer

In the present invention, a release layer may optionally be provided to allow the light-sensitive element to be peeled off the image receiving element after processing. Accordingly, the release layer should be one which can be easily peeled off after processing. In one embodiment, the materials which form the release layer are water-soluble (or alkali-soluble) cellulose derivatives such as hydroxyethyl cellulose, cellulose acetate phthalate, plasticized methyl cellulose, ethyl cellulose, cellulose nitrate or carboxymethyl cellulose. In another embodiment, natural high-molecular materials such as alginic acid, pectin and gum arabic can be used. Further, various gelatins such as acetylated gelatin and phthalated gelatin can be used.

Furthermore, water-soluble synthetic polymers such as polyvinyl alcohol, polyacrylates, polymethyl methacrylate and polybutyl methacrylate and copolymers thereof can be used.

The release layer may be composed of a single layer or a multi-layer structure comprising two or more layers as described in JP-A-59-220727 and JP-A-60-60642.

(G) Binder

Binders used in the constituent layers of the light-sensitive element and the image receiving element are preferably hydrophilic binders. Examples thereof are described in JP-A-62-253159 (pp. 26 to 28) . Specifically, transparent or semitransparent hydrophilic binders are preferred. Examples of suitable binders include natural compounds such as protein, for example, gelatin and gelatin derivatives and polysaccharides, for example, cellulose derivatives, starch, gum arabic, dextran and pullulan and synthetic high-molecular materials such as polyvinyl alcohol, polyvinyl pyrrolidone, acrylamide polymers and other synthetic high-molecular materials. Further, there can be used highly water absorbing polymers, i.e., homopolymers of a vinyl monomer having a —COOM or $SO_3M$ group (wherein M is a hydrogen atom or an alkali metal), copolymers of two or more of the vinyl monomers, and copolymers of the vinyl monomer with another vinyl monomer (e.g., sodium methacrylate, ammonium methacrylate or Sumicagel L-5H manufactured by Sumitomo Chemical Co., Ltd.) as described in JP-A-62-24526. If desired, these binders may be used in a combination of two or more of them.

The coating weight of the binder in the present invention is preferably not more than 20 g, more preferably not more than 10 g, still more preferably not more than 7 g per $m^2$.

The constituent layers (including back layer) of the light-sensitive element or the image receiving element may contain various polymer latexes to improve the physical properties of the layers, for example, to stabilize dimensions, to prevent curling or sticking from occurring, to prevent the layers from cracking or to prevent pressure sensitization. Specifically, any of the polymer latexes described in JP-A-62-245258, JP-A-62-136648 and JP-A-62-110066 can be used. When a polymer latex having a low glass transition point (not higher than 40° C.) is used in the mordant layer, the image receiving layer can be prevented from cracking, while when a polymer latex having a high glass transition point is used in the back layer, an effect of preventing curling can be obtained.

(H) Hardening agent

Examples of hardening agents which can be used in the constituent layers of the light-sensitive element or the image receiving element include those described in U.S. Pat. No. 4,678,739 (41st column), JP-A-59-116655, JP-A-62-245261 and JP-A-61-18942. More specifically, examples of suitable hardening agents include aldehyde hardening agents (e.g., formaldehyde), aziridine hardening agents, epoxy hardening agents, vinylsulfone hardening agents (N,N'-ethylene-bis(vinylsulfonylacetamido)ethane), N-methylol hardening agents (e.g., dimethylol urea) and high-molecular hardening agents (e.g., compounds described in JP-A-62-234157).

(I) Others

The constituent layers Of the light-sensitive element or the image receiving element may contain various surfactants as coating aids or to improve releasability or slipperiness, to impart antistatic properties or to accelerate development. Examples of suitable surfactants are described in JP-A-62-173463 and JP-A-62-183457.

The constituent layers of the light-sensitive element or the image receiving element may contain organofluoro compounds to improve slipperiness, impart antistatic properties or improve releasability. Typical examples of suitable organofluoro compounds include fluorine-containing surfactants as described in JP-B-57-9053 (8th to 17th columns), JP-A-61-20944 and JP-A-62-35826 and hydrophobic fluorine-containing compounds such as oily fluorine-containing compounds (e.g., fluorinated oil) and solid fluorine-containing compound resins (e.g., tetrafluoroethylene resin).

The light-sensitive element or the image receiving element may contain matting agents. Examples of suitable matting agents include silicon dioxide, compounds such as polyolefins and polymethacrylates as described in JP-A-61-88256 (page 29) and compounds such as benzoguanamine resin beads, polycarbonate resin beads and AS resin beads as described in JP-A-63-274944 and JP-A-63-274952.

Further, the constituent layers of the light-sensitive element and the image receiving element may contain anti-foaming agents, antifungal and antiseptic agents and colloidal silica. Examples of these additives are described in JP-A-61-88256 (pp. 26 to 32).

The light-sensitive element and/or the image receiving element may contain image forming accelerators. The image forming accelerators function to accelerate the oxidation reduction reaction between the silver salt oxidizing agent and the reducing agent, to accelerate the reaction for forming a dye from the dye providing compound or decomposing the dye or releasing a diffusing dye, and to accelerate the migration of a dye from the light-sensitive material layer to the dye fixing layer. The image forming accelerators can be physicochemically classified into bases or base precursors, nucleophilic compounds, high-boiling organic solvents (oils), surfactants, and compounds having an interaction with silver or silver ion. These material groups generally have a composite function and two or more of the above-described accelerating effects. The details thereof are described in U.S. Pat. No. 4,678,739 (38th to 40th columns).

(J) Processing Composition

The processing composition which can be used in the practice of the present invention is allowed to be uniformly spread over the surface of the light-sensitive element after exposure, whereby the light-sensitive layer can be developed by ingredients contained therein. Accordingly, the processing composition generally contains an alkali, a thickener, a light screening agent and an electron transfer agent (developing agent). Further, the processing composition preferably contains a development accelerator and a restrainer to control development. Furthermore, the processing composition preferably contains an antioxidant to prevent the developing agent from being deteriorated. If desired, the processing composition may contain a light-screening agent.

The alkali is used in an amount sufficient to adjust the pH of the processing solution to from 12 to 14. Examples of suitable alkalis include alkali metal hydroxides (e.g., sodium hydroxide, potassium hydroxide, lithium hydroxide), .alkali metal phosphates (e.g., potassium phosphate), guanidines and quaternary amine hydroxides (e.g., tetramethylammonium hydroxide). Among them, potassium hydroxide and sodium hydroxide are particularly preferred.

The thickener is used to spread the processing solution uniformly, to maintain the adhesion between the light-sensitive element and the image receiving element during development and to prevent ingredients in the processing solution from being left behind on the surface of the image receiving element during peeling-off.

Examples of suitable thickeners include polyvinyl alcohol, hydroxyethyl cellulose and alkali metal salts of carboxymethyl cellulose. Among them, hydroxyethyl cellulose and sodium carboxymethyl cellulose are preferred.

When the image receiving element has a transparent support and does not have a light screening function, a light screening agent can be incorporated in the processing composition.

As the light-screening agent, any suitable dye or pigment or combination thereof can be used, so long as the agent does not diffuse into the dye image receiving layer and no stain is formed. A typical example of a light screening agent is carbon black. Further, a combination of titanium white and a dye can be used. The dye may be a temporarily light-screening dye which becomes colorless after a lapse of a given period of time after processing.

Any suitable electron transfer agent can be preferably used, so long as it cross-oxidizes electron donors and does not substantially form stain even when oxidized. Such electron transfer agents may be used either alone or in a combination of two or more of them. They may be used in the form of a precursor. Specifically, suitable electron transfer agents are aminophenols and pyrazolidinones. Pyrazolidinones are particularly preferred from the viewpoint of scarcely forming stain.

Specific examples of pyrazolidinones include 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl-4-hydroxy-methyl-3-pyrazolidinone and 1-p-tolyl-4-methyl-4-hydroxymethyl-3-pyrazolidinone.

It is preferred that the processing composition be packed into a container which can be ruptured by pressure as described in U.S. Pat. Nos. 2,543,181, 2,643,886, 2,653,732, 2,723,051, 3,056,491, 3,056,492 and 3,152,515.

(K) Constitution of Light-Sensitive Material

An instant color light-sensitive material for diffusion transfer can be prepared by combining the above-described elements.

The instant color film unit for diffusion transfer can be roughly classified into a peeling-off type and a non-peeling-off type. The peeling-off type has a structure such that the light-sensitive layer and the dye image receiving layer are coated on separate supports. After imagewise exposure, the light-sensitive element and the dye image receiving element are placed in contact with each other, the processing composition is allowed to be spread therebetween, and the dye image element to obtain a dye image transferred onto the dye image receiving layer.

On the other hand, the non-peeling-off type has a structure such that the dye image receiving layer and the light-sensitive layer are coated between a transparent support and another support. This type can be classified into a type where the image receiving layer and the light-sensitive layer are coated on the same transparent support and a type where they are coated on the other support.

In the former case, a white color reflection layer is coated between the image receiving layer and the light-sensitive layer, and in the latter case, a white pigment is contained in the processing composition to be spread between the image receiving layer and the silver halide emulsion layer, whereby a dye image transferred onto the image receiving layer can be observed by reflected light.

In the peeling-off type, the image receiving element and the light-sensitive element are generally coated on separate supports. In the image receiving element, the dye image receiving layer and optionally the layer having a neutralization function, the neutralization timing layer and the release layer are provided. It is preferred that the support for the image receiving element be a white color support having a light-screening function. In the light-sensitive element, the light-sensitive layer and optionally the layer having a neutralization function and the neutralization timing layer are provided. It is preferred that the support for the light-sensitive element be a black support having a light-screening function. Film units described in JP-A-61-47956 can be used in the present invention.

Further, film units comprising the dye image receiving layer/the release layer/the light-sensitive layer in this order coated on the same support as described in JP-A-1-198747 and JP-A-2-282253 can be applied as the peeling-off type to the present invention.

In the case of the non-peeling-off type where the light-sensitive layer and the image receiving layer are coated on the same support, a cover sheet material provided with the layer having a neutralization function and the neutralization timing layer is used on the surface of the other transparent support. Film units described in JP-A-46-16356 and JP-A-50-13040 can be applied to the present invention.

The present invention is now illustrated in greater detail by reference to the following examples which, however, are not to be construed as limiting the present invention in any way.

EXAMPLE 1

First, the preparation of silver halide emulsions will be described below.

Two kinds of silver halide emulsions grains (Emulsion-1 and Emulsion-2) as indicated in Table 1 were prepared in the following method for preparing emulsions.

Subsequently, these emulsion grains were subjected to chemical sensitization and spectral sensitization as described hereinafter to prepare emulsions (Emulsion-1B, Emulsion-2B, Emulsion-1Y, Emulsion-2Y, Emulsion-1DB, Emulsion-2DB) for blue-sensitive layers, emulsions (Emulsion-1G, Emulsion-2G) for green-sensitive layers and emulsions (Emulsion-1R-(1) to Emulsion-1R(4), Emulsion-2R-(1) to Emulsion-2R-(8)) for red-sensitive layers.

TABLE 1

| | Emulsion grains prepared | |
|---|---|---|
| Emulsion grain No. | Grain size | Halogen composition |
| Emulsion-1 | monodisperse cubic grains having a diameter of 0.80 μm | AgBr |
| Emulsion-2 | tabular grains having a thickness of 0.22 μm | AgBr |

TABLE 1-continued

| Emulsion grain No. | Emulsion grains prepared: Grain size | Halogen composition |
|---|---|---|
| | and a diameter of 1.76 μm | |

TABLE 2

| Emulsion grain No. | Emulsion for blue-sensitive, green-sensitive and red-sensitive layer: Emulsion for blue-sensitive layer | Emulsion for green-sensitive layer | Emulsion for red-sensitive layer |
|---|---|---|---|
| Emulsion-1 | Emulsion-1B<br>Emulsion-1Y<br>emulsion-1DB | Emulsion-1G | Emulsion-1R-(1)<br>Emulsion-1R-(2)<br>Emulsion-1R-(3)<br>Emulsion-1R-(4) |
| Emulsion-2 | Emulsion-2B<br>Emulsion-2Y<br>Emulsion-2DB | Emulsion-2G | Emulsion-2R-(1)<br>Emulsion-2R-(2)<br>Emulsion-2R-(3)<br>Emulsion-2R-(4)<br>Emulsion-2R-(5)<br>Emulsion-2R-(6)<br>Emulsion-2R-(7)<br>Emulsion-2R-(8) |

Preparation of Emulsion-1 (Monodisperse Cubic Silver Bromide Grains Having a Diameter of 0.80 μm)

Solutions I to III indicated in Table 3 were prepared, and the Emulsion-1 grains were prepared by using these solutions.

TABLE 3

| Aqueous solution | Composition of aqueous solution |
|---|---|
| Solution I | aqueous solution containing 30 g of inert gelatin and 0.07 g of KBr, each amount being per liter. |
| Solution II | aqueous solution containing 170 g of $AgNO_3$ per liter |
| Solution III | aqueous solution containing 116.2 g of KBr per liter |

To Solution I, Solution II and Solution III were added by means of the double jet process while keeping the pAg at 7.1 in the first stage and in the second stage as shown in Table 4. After the completion of the addition, Emulsion-1 was cooled to 35° C. and washed by a conventional flocculation method, and 50 g of ossein gelation was added thereto. The pH of the emulsion was adjusted to 6.5 at 40° C. and the pAg thereof was adjusted to 8.5. The emulsion was stored in a cool dark place.

TABLE 4

| First stage: Solution II (cc) | Solution III (cc) | addition time | Second stage: Solution II (cc) | Solution III (cc) | addition time |
|---|---|---|---|---|---|
| 118 | 118 | 20 min | 471 | 471 | 40 min |

Preparation of Emulsion-2 (Tabular Silver Bromide Grains Having a Thickness of 0.22 μm and a diameter of 1.76 μm)

To one liter of a 0.8 wt % aqueous gelatin solution containing 0.05M potassium bromide, 30 cc of an aqueous solution of 0.40M silver nitrate and 30 cc of an aqueous solution of 0.15M potassium bromide were added with stirring by means of the double jet process. During addition, the temperature of the aqueous gelatin solution was kept at 30° C. After addition, the temperature was elevated to 75° C., and 30 g of gelatin was added.

After the completion of the above first stage addition, 90 cc of an aqueous solution of 0.4M silver nitrate was added.

Subsequently, 176 g of silver nitrate was added thereto over a period of 65 minutes at such an accelerating rate that the flow rate at the time of completion of addition was 21 times the flow rate at the time of the commencement of the addition. During addition, pBr was kept at 2.40.

The thus-formed grains (hereinafter referred to as seed crystals) were washed by a conventional flocculation method, and gelatin was added thereto.

Subsequently, the pH was adjusted to 6.5 at 40° C., and the pAg was adjusted to 8.0.

The thus-prepared seed crystal emulsion contained 203 g of silver halide per kg of the emulsion.

The above seed crystal emulsion was dissolved in 3.7 of an aqueous solution containing 0.8 wt % gelatin. The temperature thereof was kept at 75° C., and the pBr was kept at 1.60. Subsequently, 107 g of silver nitrate was added thereto while keeping the pBr at 1.60.

Further, ammonium thiocyanate was added thereto, and silver nitrate was then added thereto in such an amount as to give a pBr of 2.70.

The emulsion was cooled to 35° C. and washed by a conventional flocculation method, and gelatin was added thereto. The pH of the emulsion was adjusted to 6.5 at 40° C. and the pAg thereof was adjusted to 8.5. The emulsion was stored in a cool dark place. The resulting tabular grains had a mean diameter of 1.3 μm in terms of the mean diameter of circles having an area equal to that of the projected areas and a mean thickness of 0.25 μm. The emulsion contained 213 g of silver halide per kg of the emulsion.

Preparation of Emulsions (Emulsion-1G, Emulsion-2G) For Green-Sensitive Layers

One kg of each of Emulsion-1 and Emulsion-2 was weighed, and 0.15 g of sodium benzenethiosulfonate was added thereto at 55° C. Subsequently, 0.55 g of the following Sensitizing Dye S-1 was added thereto. After 0.1 g of 4-hydroxy-6-methyl-1,3,3a, 7-tetrazaindene was added thereto, $2\times10^{-3}$ g of $Na_2S_2O_3$, $4\times10^{-3}$ g of $KAuCl_4$ and 0.13 g of potassium thiocyanate were added thereto, and chemical ripening was carried out. When the maximum sensitivity was obtained, the temperature was lowered to terminate chemical sensitization, thus preparing emulsions for green-sensitive layers. Namely, Emulsion-1G (from Emulsion-1) and Emulsion-2G (from Emulsion-2) were prepared.

Preparation of Emulsions (Emulsion-1B, Emulsion-2B) For Blue-Sensitive Layers

Emulsions for blue-sensitive layers, i.e., Emulsion-1B (from Emulsion-1) and Emulsion-2B (from Emulsion-2) were prepared in the same manner as in the preparation of the emulsions for the green-sensitive layers, except that the following Sensitizing Dye S-2 was used in place of Sensitizing Dye S-1.

Sensitizing Dye S-1

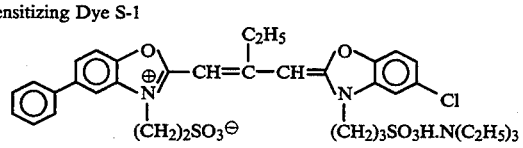

Sensitizing Dye S-2

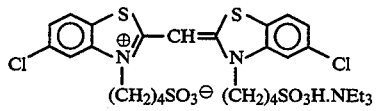

Preparation of Emulsions (Emulsion-1Y, Emulsion-2Y) for Blue-Sensitive Layers

One kg of each of Emulsion-1 and Emulsion-2 was weighed, and 0.15 g of sodium benzenethiosulfonate was added thereto at 55° C. After 0.1 g of 4-hydroxy-6-methyl-1,3,3a,7-tetrazaindene was added thereto, $2\times10^{-3}$ g of $Na_2S_2O_3$, $4\times10^{-3}$ g of $KAuCl_4$ and 0.13 g of potassium thiocyanate were added thereto, and chemical ripening was carried out. When the maximum sensitivity was obtained, the temperature was lowered to terminate chemical sensitization, thus preparing emulsions for blue-sensitive layers. Namely, Emulsion-1Y (from Emulsion-1) and Emulsion-2Y (from Emulsion-2) were prepared.

Preparation of Emulsions (Emulsion-1R-(1) to Emulsion-1R-(4), Emulsion-2R-(1) to Emulsion-2R-(8)) For Red-Sensitive Layers One kg of each of Emulsion-1 and Emulsion-2 was weighed, and 0.15 g of sodium benzenethiosulfonate was added thereto at 55° C. Subsequently, 0.55 g of a sensitizing dye (D-I-1, D-I-2, D-I-3, D-II-1, D-II-4) of the present invention, indicated in Table 5, was added (the sensitizing dye added at this stage was referred to as the sensitizing dye used as a chemical sensitization aid). After 0.1 g of 4-hydroxy-6-methyl-1,3,3a,7-tetrazaindene was added thereto, $2\times10^{-3}$ g of $Na_2S_2O_3$, $4\times10^{-3}$ g of $KAuCl_4$ and 0.13 g of potassium thiocyanate were added thereto, and chemical ripening was carried out. When the maximum sensitivity was obtained, the temperature was lowered to terminate chemical sensitization.

The thus-prepared emulsions were dissolved at 40° C., and the desorption and re-adsorption of the sensitizing dyes were carried out.

The solid adsorbent used for desorption was MCI GEL CHP-20P having a particle size of 75 to 150 μm manufactured by Mitsubishi Kasei Corp. (which was the porous synthetic resin having no ion exchange group), and 200 g of the solid adsorbent per kg of the emulsion was added, and the emulsion was stirred. After stirring was conducted for one hour, the emulsion was immediately filtered through a microfilter having a pore size of 10 μm to separate the solid adsorbent from the emulsion. The absorption spectrum of the emulsion which was the filtrate was measured by using a Hitachi 307 type color analyzer. It was confirmed that the sensitizing dyes used as chemical sensitization aids were completely desorbed.

The temperature of the emulsion was kept at 55° C., and 0.55 g (corresponding to a concentration of $4\times10^{-3}$ mol/l) (per kg of the emulsion) of Sensitizing Dye (D-II-1, D-II-4) of the present invention, indicated in Table 5, was added to the emulsion, and the emulsion was stirred for 20 minutes (the sensitizing dye added at this stage was referred to as the sensitizing dye used for spectral sensitization).

In this manner, the emulsions for red-sensitive layers were prepared. Namely, Emulsion-IR-(1) to Emulsion-1R-(4) (from Emulsion-1) and Emulsion-2R-(1) to Emulsion-2 R-(8 ) (from Emulsion-2) were prepared.

Preparation of emulsions (Emulsion-1DB Emulsion-2 DB) for blue-sensitive layers

Emulsions for blue-sensitive layers, i.e., Emulsion-1DB (from Emulsion-1) and Emulsion-2 DB (from Emulsion-2) were prepared in the same manner as in the preparation of the emulsions for red-sensitive layers except that without carrying out spectral sensitization, the emulsions were chemically sensitized by using the Sensitizing Dye (D-I-2) of the present invention, as indicated in Table 5, and the desorption of the sensitizing dye was then carried.

The combinations of the sensitizing dyes used are shown in Table 5. Table 5 also shows whether the desorption of the sensitizing dyes was carried out or not.

TABLE 5

| Emulsion No. | Emulsion grain No. | Sensitizing Dye for chemical sensitization aid | Desorption of sensitizing dye | Sensitizing dye for spectral sensitization |
|---|---|---|---|---|
| Emulsion-1R-(1) | Emulsion-1 | D-II-4 | not made | — |
| Emulsion-1R-(2) | Emulsion-1 | D-II-1 | not made | — |
| Emulsion-1R-(3) | Emulsion-1 | D-I-2 | made | D-II-4 |
| Emulsion-1R-(4) | Emulsion-1 | D-I-2 | made | D-II-1 |
| Emulsion-2R-(1) | Emulsion-2 | D-II-4 | not made | — |
| Emulsion-2R-(2) | Emulsion-2 | D-II-1 | not made | — |
| Emulsion-2R-(3) | Emulsion-2 | D-I-2 | made | D-II-4 |
| Emulsion-2R-(4) | Emulsion-2 | D-I-2 | made | D-II-1 |
| Emulsion-2R-(5) | Emulsion-2 | D-I-3 | made | D-II-4 |
| Emulsion-2R-(6) | Emulsion-2 | D-I-3 | made | D-II-1 |
| Emulsion-2R-(7) | Emulsion-2 | D-I-1 | made | D-II-4 |
| Emulsion-2R-(8) | Emulsion-2 | D-I-1 | made | D-II-1 |
| Emulsion-1DB | Emulsion-1 | D-I-2 | made | — |
| Emulsion-2DB | Emulsion-2 | D-I-2 | made | — |

The preparation of the gelatin dispersion of the dye providing compound and the electron donor will be described below.

2.12 g of Cyan Dye Providing Compound (1), 0.85 g of Electron Donor (1), 0.35 g of High-boiling Organic Solvent.(1) and 0.7 g of Surfactant (1) were added to 9.5 ml of ethyl acetate. The mixture was heated at about 60° C. to dissolve it and to form a uniform solution. The resulting solution was mixed with 4.5 g of a 14% aqueous solution of lime-processed gelatin and 16 ml of water with stirring, and the mixture was dispersed in a homogenizer at 10,000 rpm for 10 minutes.

The gelatin dispersion of the magenta dye providing compound and the electron donor was prepared in the same manner as described above except that Magenta Dye Providing Compound (1) was used as the dye providing compound.

The gelatin dispersion of the yellow dye providing compound and the electron donor was prepared in the same manner as described above except that Yellow Dye Providing Compound (1) was used as the dye providing compound.

Cyan Dye Providing Compound (1)

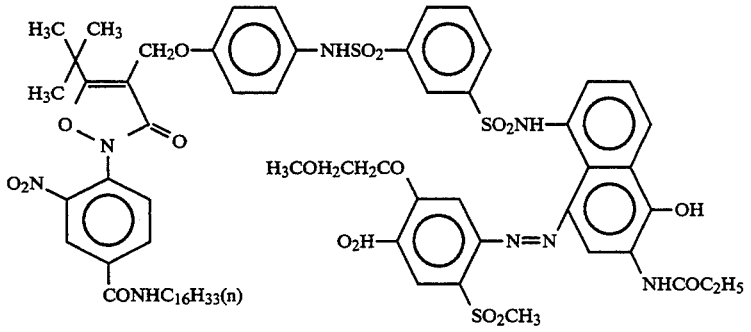

Electron Donor (1)

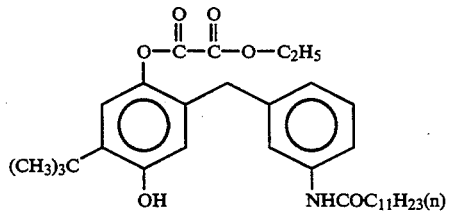

High-boiling Organic Solvent (1)
Tricyclohexyl phosphate

Surfactant (1)

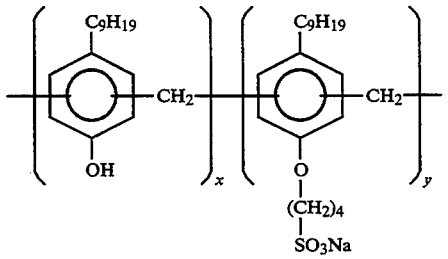

x/y = about 58/42 (by weight)

Yellow Dye Providing Compound (1)

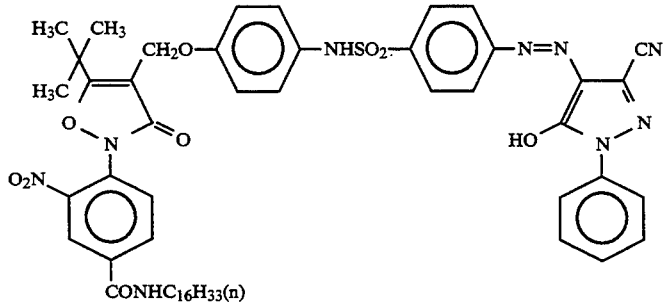

Magenta Dye Providing Compound (1)

-continued

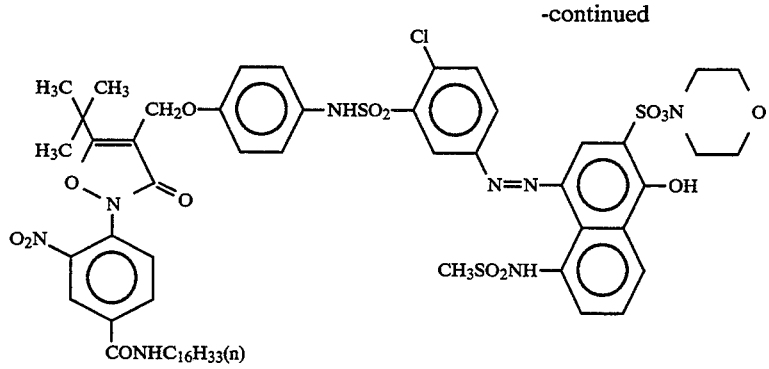

The preparation of the gelatin dispersion of the non-diffusing reducing agent for the interlayer will be described below.

23.5 g of Nondiffusing Reducing Agent (1), 6.9 g of Nondiffusing Reducing Agent (2) and 8.5 g of High-Boiling Organic Solvent (1) were added to 30 ml of ethyl acetate. The mixture was heated at about 60° C. to dissolve it and to form a uniform solution. The resulting solution was mixed with 100 g of a 10% aqueous solution of lime-processed gelatin, 15 ml of a 5% aqueous solution of Surfactant (2) and 16 ml of water with stirring, and the mixture was dispersed in a homogenizer at 10,000 rpm for 10 minutes.

Non-diffusing Reducing Agent (1)

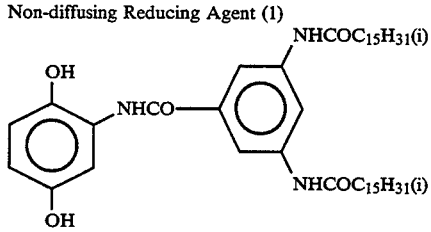

Non-diffusing Reducing Agent (2)

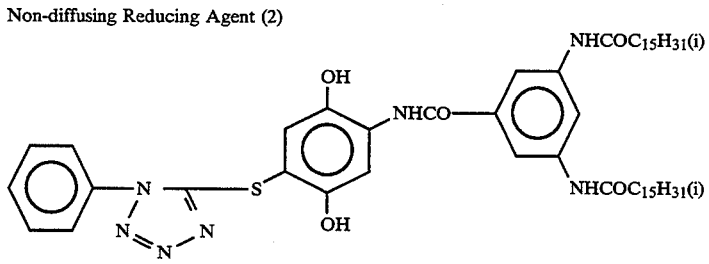

Surfactant (2)

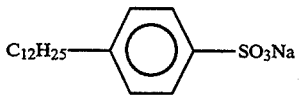

A comparative light-sensitive element (Sample having the structure indicated in Table 6 was prepared.

TABLE 6

Comparative light-sensitive material 101

| Layer No. | Layer | Additive | Amount added (g/m²) |
|---|---|---|---|
| Twelfth layer | Protective layer | Gelatin | 0.40 |
| | | Matting agent (1) | 0.25 |
| | | Hardening agent (1) | $4.8 \times 10^{-2}$ |
| | | Surfactant (3) | $1.2 \times 10^{-2}$ |
| | | Citric acid | $1.6 \times 10^{-2}$ |
| | | Water-soluble polymer (1) | $5.8 \times 10^{-2}$ |
| Eleventh layer | Ultraviolet light absorbing layer | Gelatin | 0.47 |
| | | Ultraviolet light absorber (1) | 0.14 |
| | | Ultraviolet light absorber (2) | 0.13 |
| | | Surfactant (2) | $7.0 \times 10^{-3}$ |
| | | Water-soluble polymer (1) | $7.0 \times 10^{-2}$ |
| Tenth layer | Blue-sensitive layer | Emulsion 1-B (in terms of silver) | 0.50 |
| | | Gelatin | 0.41 |
| | | Anti-fogging agent (1) | $1.6 \times 10^{-4}$ |
| | | Surfactant (2) | $6.5 \times 10^{-3}$ |
| | | Water-soluble polymer (1) | $6.8 \times 10^{-3}$ |
| Ninth layer | Yellow dye material layer | Yellow dye providing compound (1) | 0.42 |
| | | Electron donor (1) | 0.23 |
| | | Gelatin | 0.51 |
| | | High-boiling organic solvent (1) | $6.8 \times 10^{-2}$ |
| | | Surfactant (1) | 0.14 |
| | | Water-soluble polymer (1) | $5.1 \times 10^{-3}$ |
| Eighth layer | Interlayer | Gelatin | 0.32 |
| | | Matting agent (1) | $2.2 \times 10^{-2}$ |
| | | Surfactant (3) | $1.1 \times 10^{-2}$ |
| | | Water-soluble polymer | $1.2 \times 10^{-2}$ |

TABLE 6-continued

| | | | |
|---|---|---|---|
| | | (1) | |
| Seventh layer | Interlayer | Gelatin | 0.69 |
| | | Nondiffusing reducing agent (1) | 0.30 |
| | | Nondiffusing reducing agent (2) | $8.8 \times 10^{-2}$ |
| | | High-boiling organic solvent (1) | 0.13 |
| | | Surfactant (2) | $1.1 \times 10^{-3}$ |
| | | Stabilizer (1) | $2.4 \times 10^{-3}$ |
| | | Citric acid | $1.4 \times 10^{-2}$ |
| | | Water-soluble polymer (1) | $2.8 \times 10^{-2}$ |
| Sixth layer | Green-sensitive layer | Emulsion-1G (in terms of gelatin) | 0.32 |
| | | Gelatin | 0.38 |
| | | Anti-fogging agent (1) | $9.9 \times 10^{-5}$ |
| | | Surfactant (2) | $6.5 \times 10^{-3}$ |
| | | Water-soluble polymer (1) | $6.8 \times 10^{-3}$ |
| Fifth layer | Magenta dye material layer | Magenta dye providing compound (1) | 0.39 |
| | | Electron donor (1) | 0.17 |
| | | Gelatin | 0.39 |
| | | High-boiling organic solvent (1) | $6.5 \times 10^{-2}$ |
| | | Surfactant (1) | 0.12 |
| | | Water-soluble polymer (1) | $8.5 \times 10^{-3}$ |
| Fourth layer | Interlayer | Gelatin | 0.32 |
| | | Matting agent (1) | $2.2 \times 10^{-2}$ |
| | | Surfactant (3) | $1.1 \times 10^{-2}$ |
| | | Water-soluble polymer (1) | $1.2 \times 10^{-2}$ |
| Third layer | Interlayer | Gelatin | 0.69 |
| | | Nondiffusing reducing agent (1) | 0.30 |
| | | Nondiffusing reducing agent (2) | $8.8 \times 10^{-2}$ |
| | | High-boiling organic solvent (1) | 0.13 |
| | | Surfactant (2) | $1.1 \times 10^{-3}$ |
| | | Stabilizer (1) | $2.4 \times 10^{-3}$ |
| | | Citric acid | $1.4 \times 10^{-2}$ |
| | | Water-soluble polymer (1) | $2.8 \times 10^{-2}$ |
| Second layer | Red-sensitive layer | Emulsion-1R-(1) (in terms of silver) | 0.27 |
| | | Gelatin | 0.38 |
| | | Anti-fogging agent (1) | $8.5 \times 10^{-5}$ |
| | | Surfactant (2) | $6.5 \times 10^{-3}$ |
| | | Water-soluble polymer (1) | $6.8 \times 10^{-3}$ |
| First layer | Cyan dye material layer | Cyan dye providing compound (1) | 0.41 |
| | | Electron donor (1) | 0.16 |
| | | Gelatin | 0.40 |
| | | High-boiling organic solvent (1) | $6.8 \times 10^{-2}$ |
| | | Surfactant (1) | 0.14 |
| | | Water-soluble polymer (1) | $1.0 \times 10^{-2}$ |
| Support (polyethylene terephthalate of 100 μm) | | | |
| Back layer | | Carbon black | 4.0 |
| | | Gelatin | 2.0 |

Hardening agent (1)
1,2-Bis(vinylsulfonylacetamido)ethane
Matting Agent (1)
Spherical latex of polymethyl methacrylate (average particle size: 4 μm)
Ultraviolet Light Absorber (1)

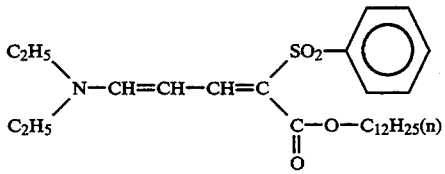

TABLE 6-continued

Ultraviolet Light Absorber (2)

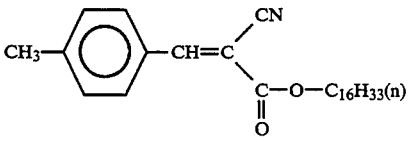

Water-soluble Polymer (1)

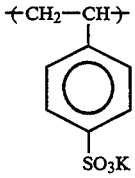

Surfactant (3)
Aerosol OT
Anti-fogging Agent (1)

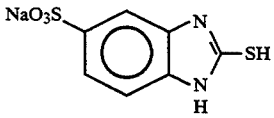

Stabilizer (1)

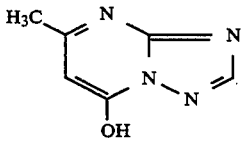

The image receiving element was prepared in the following manner.

Paper support:

Each of both sides of paper of 150 μm in thickness was laminated with polyethylene of 30 μm. The polyethylene on the image receiving layer side contained (based on the weight of polyethylene) of titanium oxide dispersed therein.

Back side (a) A light-screening layer comprising 4.0 g/$m_2$ of carbon black and 2.0 g/$m^2$ of gelatin.

(b) A white color layer comprising 8.0 g/$m^2$ of titanium oxide and 1.0 g/$m^2$ of gelatin.

(c) A protective layer comprising 0.6 g/$m^2$ of gelatin.

These layers were coated in order of (a), (b) and (c) and hardened by a hardening agent. Image receiving layer side (1) A neutralization layer containing 22 g/$m^2$ of an acrylic acid-butyl acrylate (8:2 by mol) copolymer having an average molecular weight of 50,000.

(2) A second timing layer containing 4.5 g/$m^2$ of cellulose acetate having a degree of oxidation of 51.3% (the weight of acetic acid released by hydrolysis being 0.513 g per one gram of the sample) and a styrene-maleic anhydride (1:1 by mol) copolymer having an average molecular weight of about 10,000 in a ratio of 95:5 by weight.

(3) An interlayer containing 0.4 g/$m^2$ of poly-2 hydroxyethyl methacrylate.

(4) A first timing layer containing 1.6 g/$m^2$ (on a total solids basis) of a blend consisting of a polymer latex, obtained by emulsion polymerizing styrene/butyl acrylate/acrylic acid/N-methylol acrylamide in a ratio of 49.7/42.3/4/4 by weight, and a polymer latex, obtained by emulsion polymerizing methyl methacrylate/acrylic acid/N-methylol acrylamide in a ratio of 93/3/4 by weight, in a ratio of 6:4 (on a solids basis).

(5) An image receiving layer formed by coating 3.0 g/m$^2$ of a polymer mordant having the following repeating unit and 3.0 g/m$^2$ of gelatin by using the following coating aid.

(6) A protective layer formed by coating 0.6 g/m$^2$ of gelatin.

These layers were coated in order of (1), (2), (3), (4), (5) and (6) and hardened by using a hardening agent.

Coating Aid

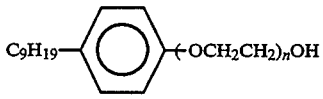

(n = 30)

Repeating Unit

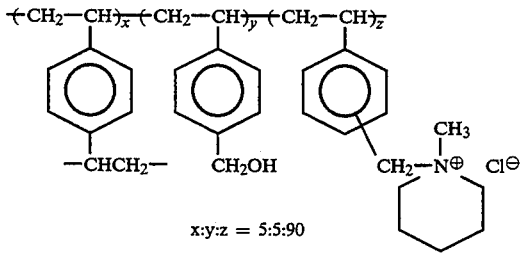

x:y:z = 5:5:90

A processing solution having the following composition was prepared, and 0.8 g of the processing solution was charged into a rupturable container:

| | |
|---|---|
| 1-p-Tolyl-4-hydroxymethyl-4-methyl-3-pyrazolidone | 10.0 g |
| 1-Phenyl-4-hydroxymethyl-4-methyl-3-pyrazolidone | 4.0 g |
| Potassium sulfite (anhydrous) | 4.0 g |
| Hydroxyethyl cellulose | 40 g |
| Potassium hydroxide | 64 g |
| Benzyl alcohol | 2.0 g |
| Add water to make the total amount | 1 kg |

Samples 102 to 116 were prepared in the same manner as in the preparation of Sample 101, except that one of Emulsion-1R-(1) to Emulsion-1R-(4) or Emulsion2 R-(1) to Emulsion-2 R-(8) was used as the emulsion in the second layer, Emulsion-1G or Emulsion-2G was used as the emulsion in the sixth layer, and Emulsion-1B or Emulsion-2B, Emulsion-1Y or Emulsion-2Y, or Emulsion-1DB or Emulsion-2 DB was used as the emulsion in the tenth layer, as indicated in Table 7.

TABLE 7

| | Emulsions used | | |
|---|---|---|---|
| Sample No. | Second layer (red-sensitive layer) | Sixth layer (green-sensitive layer) | Tenth layer (blue-sensitive layer) |
| 101 (Comp. Ex.) | Emulsion-1R-(1) | Emulsion-1G | Emulsion-1B |
| 102 (Comp. Ex.) | Emulsion-1R-(2) | Emulsion-1G | Emulsion-1B |
| 103 (Invention) | Emulsion-1R-(3) | Emulsion-1G | Emulsion-1B |
| 104 (Invention) | Emulsion-1R-(4) | Emulsion-1G | Emulsion-1B |
| 105 (Comp. Ex.) | Emulsion-2R-(1) | Emulsion-2G | Emulsion-2B |
| 106 (Comp. Ex.) | Emulsion-2R-(2) | Emulsion-2G | Emulsion-2B |
| 107 (Invention) | Emulsion-2R-(3) | Emulsion-2G | Emulsion-2B |
| 108 (Invention) | Emulsion-2R-(4) | Emulsion-2G | Emulsion-2B |
| 109 (Invention) | Emulsion-2R-(5) | Emulsion-2G | Emulsion-2B |
| 110 (Invention) | Emulsion-2R-(6) | Emulsion-2G | Emulsion-2B |
| 111 (Invention) | Emulsion-2R-(7) | Emulsion-2G | Emulsion-2B |
| 112 (Invention) | Emulsion-2R-(8) | Emulsion-2G | Emulsion-2B |
| 113 (Comp. Ex.) | Emulsion-1R-(1) | Emulsion-1G | Emulsion-1Y |
| 114 (Comp. Ex.) | Emulsion-1R-(1) | Emulsion-1G | Emulsion-2Y |
| 115 (Invention) | Emulsion-1R-(1) | Emulsion-1G | Emulsion-1DB |
| 116 (Invention) | Emulsion-1R-(I) | Emulsion-1G | Emulsion-2DB |

The light-sensitive elements (Samples 101 to 116) were exposed to light through a grey filter from the emulsion layer side. The light-sensitive element was put upon the image receiving layer side of the image receiving element. The processing solution was spread between both elements with the aid of pressure rollers so that the thickness of the processing solution was 60 μm. Processing was carried out at 25° C. After 1.5 minutes, the light-sensitive element and the image receiving element were peeled off from each other.

The reflection density of the image transferred to each image receiving element was measured with a color densitometer.

The results are shown in Table 8.

TABLE 8

| | Maximum density | | | Minimum density | | | Relative sensitivity* | | |
|---|---|---|---|---|---|---|---|---|---|
| Sample No. | Y | M | Cy | Y | M | Cy | Y | M | Cy |
| 101 (Comp. EX.) | 2.25 | 2.20 | 1.80 | 0.31 | 0.33 | 0.32 | 100 | 100 | 100 |
| 102 (Comp. EX.) | 2.20 | 2.22 | 1.85 | 0.31 | 0.32 | 0.31 | 103 | 98 | 98 |
| 103 (Invention) | 2.23 | 2.23 | 2.20 | 0.30 | 0.33 | 0.33 | 105 | 105 | 135 |
| 104 (Invention) | 2.26 | 2.18 | 2.30 | 0.32 | 0.33 | 0.33 | 103 | 105 | 132 |
| 105 (Comp. EX.) | 2.23 | 2.22 | 1.60 | 0.27 | 0.29 | 0.29 | 110 | 120 | 105 |
| 106 (Comp. EX.) | 2.20 | 2.24 | 1.68 | 0.28 | 0.28 | 0.28 | 108 | 122 | 105 |
| 107 (Invention) | 2.21 | 2.20 | 2.32 | 0.27 | 0.28 | 0.30 | 114 | 124 | 163 |
| 108 (Invention) | 2.23 | 2.23 | 2.31 | 0.27 | 0.27 | 0.29 | 116 | 123 | 160 |
| 109 (Invention) | 2.25 | 2.24 | 2.28 | 0.28 | 0.29 | 0.29 | 115 | 125 | 150 |
| 110 (Invention) | 2.23 | 2.20 | 2.32 | 0.29 | 0.30 | 0.29 | 117 | 124 | 152 |
| 111 (Invention) | 2.22 | 2.22 | 2.30 | 0.27 | 0.28 | 0.30 | 114 | 125 | 145 |

TABLE 8-continued

| Sample No. | Maximum density | | | Minimum density | | | Relative sensitivity* | | |
|---|---|---|---|---|---|---|---|---|---|
| | Y | M | Cy | Y | M | Cy | Y | M | Cy |
| 112 (Invention) | 2.21 | 2.22 | 2.30 | 0.27 | 0.29 | 0.29 | 113 | 123 | 150 |
| 113 (Comp. EX.) | 1.80 | 2.10 | 1.72 | 0.31 | 0.33 | 0.33 | 55 | 105 | 102 |
| 114 (Comp. EX.) | 1.76 | 2.11 | 1.70 | 0.28 | 0.33 | 0.33 | 48 | 103 | 101 |
| 115 (Invention) | 2.30 | 2.23 | 1.84 | 0.30 | 0.32 | 0.32 | 70 | 100 | 99 |
| 116 (Invention) | 2.28 | 2.25 | 1.85 | 0.27 | 0.32 | 0.32 | 68 | 99 | 100 |

*Relative sensitivity: relative value (anti-logarithm) when the sensitivity of each layer of Sample 101 at a density of 1.0 is referred to as 100.

The results in Table 8 show that according to the present invention an excellent image can be obtained using the color diffusion transfer photographic material of the invention, which is highly sensitive and has a high maximum density (namely, the fog of the emulsion is low).

While the present invention has been described in detail and with reference to specific embodiments thereof, it will be apparent to one skilled in the art that various changes and modifications can be made therein without departing from the spirit and scope of the present invention.

What is claimed is:

1. A color diffusion transfer photographic material which comprises a support having thereon one or more light-sensitive silver halide emulsion layers combined with a reducible dye providing compound represented by the following general formula (I) and an electron donor, said reducible dye providing compound releasing a diffusing dye when reduced, wherein at least one of the silver halide emulsion layers contains a silver halide emulsion obtained by:

chemically sensitizing the silver halide emulsion in the presence of a first sensitizing dye which is adsorbed into the silver halide emulsion, and treating the silver halide emulsion with a solid adsorbent consisting of a porous organic synthetic resin having no ion exchange group to desorb substantially all of the first sensitizing dye:

$$PWR\text{-}(Time)_t\text{-}Dye \qquad (I)$$

wherein PWR represents a group which releases -(Time)$_t$ -Dye when reduced; Time is a group which releases Dye through subsequent reactions after -(Time)$_t$- Dye is released from PWR; t represents an integer of 0 or 1; and Dye represents a dye or a precursor thereof.

2. A color diffusion transfer photographic material as in claim 1, wherein the silver halide emulsion obtained by:

chemically sensitizing the silver halide emulsion in the presence of a first sensitizing dye which is adsorbed into the silver halide emulsion, and treating the silver halide emulsion with a solid adsorbent to desorb substantially all of the first sensitizing dye, is further:

treated with a second sensitizing dye, which may the same or different as the first sensitizing dye, such that the second sensitizing dye is adsorbed by the silver halide emulsion.

3. A color diffusion transfer photographic material as in claim 2, wherein the first sensitizing dye is different from the second sensitizing dye.

4. A color diffusion transfer photographic material as in claim 3, wherein the first sensitizing dye is a compound represented by formula (D-1), and the second sensitizing dye is a compound represented by formula (D-2):

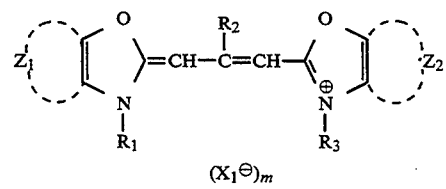

(D-1)

wherein Z 1 and $Z_2$ may be the same or different and each represents a non-metallic atomic group required for forming a benzene ring or a naphthalene ring; $R_1$ and $R_3$ may be the same or different and each represents a substituted or unsubstituted alkyl group; $R_2$ represents a hydrogen atom, a substituted or unsubstituted alkyl group or a substituted or unsubstituted aryl group; represents an anion; and m represents 0 or 1 and when m=0, the compound forms an inner salt;

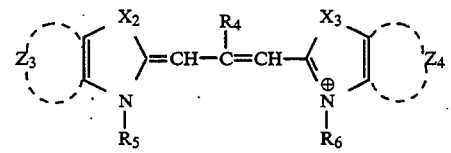

(D-2)

wherein $X_2$ and $X_3$ independently represent a sulfur atom or a selenium atom; $Z_3$ and $Z_4$ each represents a nonmetallic atomic group required for forming a benzene ring or a naphthalene ring; $R_4$ represents a hydrogen atom, an alkyl group having not more than 6 carbon atoms, an aralkyl group having not more than 12 carbon atoms or a phenyl group; $R_5$ and $R_6$ each represents an alkyl group having not more than 10 carbon atoms or an alkyl group having not more than 10 carbon atoms substituted by one or more of a sulfo group, a hydroxyl group, a carboxyl group, a carbamoyl group, a sulfophenyl group, a carboxyphenyl group, an alkoxy group, a phenyl group or a halogen atom, and at least one of $R_5$ and $R_6$ is a group having a sulfo group or a carboxyl group.

5. A color diffusion transfer photographic material as in claim 4, wherein the sensitizing dye of formula (D-2) is a sensitizing dye of formula (D-3):

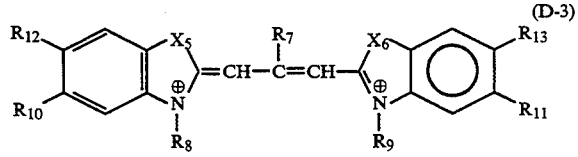

(D-3)

wherein $X_5$ and $X_6$ may be the same or different and each represents a sulfur atom or a selenium atom; $R_7$ represents an ethyl group, a propyl group, a butyl group or a phenethyl group; $R_8$ and $R_9$ each represents a sulfoalkyl group having 2 to 4 carbon atoms, a carboxyalkyl group having 2 to 5 carbon atoms, a hydroxyalkyl group having 2 to 6 carbon atoms, an unsubstituted carbamoyl group-substituted alkyl group having 2 to 5 carbon atoms or a lower alkyl group having not more than 6 carbon atoms; at least one of $R_8$ and $R_9$ is a group having a sulfo group or a carboxyl group; $R^{10}$ and $R_{11}$ independently represent a hydrogen atom, a chlorine atom, a bromine atom, a lower alkyl group having 1 to 7 carbon atoms, a lower alkoxy group having 1 to 6 carbon atoms, a carboxyl group, a hydroxyl group, an alkoxycarbonyl group having 2 to 5 carbon atoms, an acylamino group in which the acyl moiety has 2 to 5 carbon atoms or a phenyl group; and $R_{12}$ and $R_{13}$ independently represent a hydrogen atom, a chlorine atom, a bromine atom, a lower alkyl group having 1 to 7 carbon atoms, an alkoxy group having 1 to 6 carbon atoms, a hydroxyl group or an acylamino group in which the acyl moiety has 2 to 5 carbon atoms.

* * * * *